US008934646B2

(12) United States Patent
Hagiwara et al.

(10) Patent No.: US 8,934,646 B2
(45) Date of Patent: Jan. 13, 2015

(54) AUDIO MIXER

(75) Inventors: Hideki Hagiwara, Hamamatsu (JP); Hiroaki Fujita, Hamamatsu (JP); Takamitsu Aoki, Hamamatsu (JP)

(73) Assignee: Yamaha Corporation (JP)

( * ) Notice: Subject to any disclaimer, the term of this patent is extended or adjusted under 35 U.S.C. 154(b) by 308 days.

(21) Appl. No.: 13/454,563

(22) Filed: Apr. 24, 2012

(65) Prior Publication Data

US 2012/0237038 A1 Sep. 20, 2012

Related U.S. Application Data

(63) Continuation of application No. 12/730,669, filed on Mar. 24, 2010, now abandoned.

(30) Foreign Application Priority Data

Mar. 26, 2009 (JP) ..... 2009-077307
Nov. 25, 2009 (JP) ..... 2009-267864

(51) Int. Cl.
*H04H 60/04* (2008.01)
*H04S 5/02* (2006.01)
*H04S 3/00* (2006.01)
(Continued)

(52) U.S. Cl.
CPC ..... *H04S 5/005* (2013.01); *H04H 60/04* (2013.01); *H04S 3/008* (2013.01); *H04S 7/30* (2013.01); *H04S 2400/13* (2013.01)
USPC ..... 381/119; 381/17; 381/18; 381/19

(58) Field of Classification Search
USPC ..... 381/119, 17–19
See application file for complete search history.

(56) References Cited

U.S. PATENT DOCUMENTS

2002/0172370 A1 11/2002 Ito
2003/0076966 A1 4/2003 Okabayashi
2003/0086580 A1 * 5/2003 Hamamatsu ..... 381/119
(Continued)

FOREIGN PATENT DOCUMENTS

CN 1414817 A 4/2003
EP 1306993 A2 5/2003

OTHER PUBLICATIONS

Notification of the First Office Action for corresponding CN 201010139814.5, issue date Aug. 13, 2013. English translation provided.

(Continued)

*Primary Examiner* — Duc Nguyen
*Assistant Examiner* — George Monikang
(74) *Attorney, Agent, or Firm* — Rossi, Kimms & McDowell LLP

(57) ABSTRACT

Six input channels, to which are allocated 5.1-channel surround signals from a plurality of input sources, are grouped into a surround channel group, and these six input channels are connected to corresponding ones of six surround buses in a one-to-one relationship. Thus, merely grouping the input channels into a surround channel group allows the signals of the individual input channels (5.1-channel surround signals) to be taken out via a plurality of output destinations (5.1-channel speakers) corresponding to the surround buses. Once an instruction is given for changing a value of a parameter, the parameter is controlled in a ganged fashion in all of the input channels of the surround channel group except for an LFE input channel of the surround channel group.

8 Claims, 13 Drawing Sheets

(51) Int. Cl.
*H04S 5/00* (2006.01)
*H04S 7/00* (2006.01)

(56) References Cited

U.S. PATENT DOCUMENTS

2005/0157830 A1* 7/2005 Ota et al. ..... 375/377
2006/0210098 A1* 9/2006 Okabayashi et al. ..... 381/119
2007/0229474 A1 10/2007 Okabayashi
2011/0009990 A1 1/2011 Terada et al.

OTHER PUBLICATIONS

Extended European Search Report issued in European counterpart application No. EP10157286.5, dated Oct. 16, 2012.
"PM5D/PM5D-RH V2, DSP5D Owner's Manual", [online], Yamaha, Internet URL: http://www2. yamaha.co.jp/manual/pdf/pa/english/mixers/pm5dv2_en_om_g0.pdf, pp. 53,54, and 143; 2004 Yamaha Corporation. Cited in U.S. Appl. No. 12/730,669.

* cited by examiner

AUDIO MIXER

This is a continuation of U.S. patent application Ser. No. 12/730,669 filed Mar. 24, 2010, which is based on and claims priority from Japanese Application Numbers JP 2009-077307 filed on Mar. 26, 2009 and JP 2009-267864 filed Nov. 25, 2009. The disclosures of the applications cited in this paragraph, in their entireties, including the drawings, claims, and the specifications thereof, are hereby incorporated herein by reference.

BACKGROUND

The present invention relates to audio mixers and more particularly to a technique for controlling input channel settings corresponding to types of input sources.

The "5.1-channel surround" is a configuration of an audio signal output system which is configured to achieve a surround environment rich in presence by reproducing audio signals of six channels (surround signals), for which are set sound characteristics (sound image localization etc.) corresponding to a six-channel surround environment, using six speakers corresponding to the individual channels. The surround signals supply six types of audio signals corresponding to different types of output destinations, i.e. left front (L), right front (R), center front (C), left rear (Ls) and right rear (Rs) as viewed from a listener of the signals and low-pitched sound outputting subwoofer (LFE (Low Frequency Effects)).

Namely, in the 5.1-channel surround configuration, six input sources are handled together as one set, and a mutual relationship among the six input sources is set in advance regarding parameters of sound characteristics, such as sound volume level and sound image localization, in order to reproduce a predetermined surround environment.

In the conventionally-known audio mixers, when audio signals of a set of six input sources for the 5.1-channel surround are to be input, input channels are mapped or allocated to the six input sources in a one-to-one relationship so that one surround signal is input to each of the six input channels. Then, each of the input channels is connected to six mixing buses, processing, such as adjustment of levels of signals input to the mixing buses, is performed for each of the input channels and the resultant audio signals of these six mixing buses are output to six speakers corresponding to the mixing buses, to thereby reproduce the 5.1-channel surround audio signals in a surround environment, or recorded in a 5.1-channel surround configuration.

Namely, the conventionally-known audio mixers, where a plurality of input sources, whose mutual relationship was set in advance, are allocated to the different input channels, can only handle the input sources as mutually independent and mutually unrelated input sources. Thus, a human operator has to adjust parameters of each of the input channels separately from the other input channels while paying attention to the relationship among the input sources.

Further, whereas a plurality of signals to be reproduced in a surround environment should be output to a plurality of output destinations on a channel-by-channel basis, the conventionally-known audio mixers requires a human operator to also manually perform various operation, such as setting of connections of each input channel to mixing buses and adjustment of output levels, to the mixing buses, of each input channel, while paying attention to the relationship among the input sources.

Some of the conventionally-known audio mixers are equipped with a surround function (mode) for outputting audio signals to a plurality of output destinations that constitute a surround environment, such as 5.1-channel surround. However, this surround function is merely intended to realize a surround environment by outputting an audio signal of one input channel to a predetermined plurality of surround buses (see page 143 etc., "PM5D/PM5D-RH V2, DSP5D Owner's Manual", [online], Yamaha, Internet <URL: http://www2.yamaha.co.jp/manual/pdf/pa/english/mixers/pm5dv2_en_om_g0.pdf>) (hereinafter referred to as "relevant non-patent literature").

Further, some of the conventionally-known audio mixers are equipped with a function called "stereo pair setting" for handling a plurality of input channels together as a set. This stereo pair setting function is intended to set two input channels as a stereo pair to thereby achieve a ganged (or interlocked) relationship between parameters of the two input channels set as the stereo pair ((see page 53 of the above-identified non-patent literature).

However, with the conventionally-known audio mixers, a setting for handling audio signals of a plurality of channels, originally created for a surround purpose, cannot be made with the input channels of the mixer. Thus, in a case where audio signals of a plurality of channels are supplied from a plurality of input sources that are to be handled as a set as in the 5.1-channel surround or the like, cumbersome and time-consuming operation has been necessary for adjusting parameters of each of the input channels while paying attention to the relationship among the input sources and for outputting (e.g., surround-reproducing) the audio signals of the plurality of channels, which are to be handled as a set, as audio signals of a plurality of channels having a predetermined relationship thereamong.

SUMMARY OF THE INVENTION

In view of the foregoing, it is an object of the present invention to provide an improved audio mixer which can readily handle a plurality of input sources to be handled together as a set with an increased ease.

In order to accomplish the above-mentioned object, the present invention provides an improved audio mixer comprising: a plurality of input channels to which one or more audio signals supplied from input sources are inputted, each of the input channels inputting thereto any one of the audio signals; a surround bus group constituted by a given number of buses corresponding to a necessary number of channels for achieving a predetermined surround effect; a channel grouping section which groups, as a surround channel group, a given number of input channels, included among the plurality of input channels, corresponding in number to the given number of buses constituting the surround bus group, and which sets, as a non-parameter-ganging channel, at least one of the input channels belonging to the surround channel group; a connection section which connects each of the input channels, belonging to the surround channel group, to a corresponding one of the buses belonging to the surround channel group; an instruction reception section which receives a change instruction for changing a value of a parameter for one of the input channels belonging to the surround channel group; a determination section which determines whether or not the input channel, for which the change instruction has been received, is the non-parameter-ganging channel; and a parameter control section which, when the determination section has determined that the input channel, for which the change instruction has been received, is not a non-parameter-ganging channel, controls, on the basis of the change instruction, values of the parameter in all input channels of the surround channel group that are not non-parameter-ganging channels, and which, when the determination section has determined that the input channel, for which the change instruction has been received, is a non-parameter-ganging channel, controls, on the basis of the change instruction, a value of the parameter only in the input channel for which the change instruction has been received.

The channel grouping section sets or groups, as a surround channel group, a plurality of input channels to which signals of a plurality of input sources to be handled as a set (e.g., 5.1-channel surround signals). The connection section connects the input channels of a surround channel group to the buses of a surround channel group in a one-to-one relationship. In this manner, the signals of a plurality of input sources to be handled as a set (e.g., 5.1-channel surround signals) can be output (e.g., surround-reproduced), via a plurality of output channels corresponding to the surround channel group, as a set of audio signals of a plurality of channels having a predetermined relationship.

Any one of two channel types, i.e. "parameter-ganging channel" type and "non-parameter-ganging channel" type, is set for each individual input channel belonging to the surround channel group. When a parameter change in a given input channel has been instructed, the present invention can automatically determine, on the basis of the channel type (i.e., "parameter-ganging channel" type or "non-parameter-ganging channel" type) set for the input channel, whether or not to perform ganged control on the parameter within the surround channel group.

The present invention permits a setting such that signals of a plurality of channels to be handled as a set (e.g., 5.1-channel surround signals) can be output (e.g., surround-reproduced) as audio signals of a plurality of output channels having a predetermined relationship, through extremely simple operation of the channel group setting. Further, because it is possible to automatically determine whether or not to perform ganged control on a parameter within a surround channel group, a human operator can perform parameter adjustment of the input channels handling signals of a plurality of channels to be handled as a set (e.g., 5.1-channel surround signals), while maintaining a mutual relationship among input sources and without paying excessive attention to the mutual relationship among the input sources. Namely, the present invention can achieve the superior advantageous benefit that a plurality of input sources can be handled together as a set.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 5A and 5B are block diagrams explanatory of combinations of channel types set for individual input channels of an input channel block in a case where a "surround block" type is set for the input channel block, of which FIG. 5A shows a combination of channel types in a case where a first surround block type is set for the input channel block and FIG. 5B shows a combination of channel types set for individual input channels of an input channel block in a case where a second surround block type is set for the input channel block;

FIGS. 13A to 13D are conceptual diagrams explanatory of a construction of a send-level display region on the operation panel of FIG. 12, of which FIG. 13A shows a "fundamental type" display design, FIG. 13B shows a "normal channel" display design, FIG. 13C shows a "stereo channel" display design and FIG. 13D shows a "surround channel" display design;

DETAILED DESCRIPTION

First Embodiment

The following describe a mixing system that is constructed as a first embodiment of an audio mixer of the present invention.

—Outline of the Mixing System—

Figure 1:
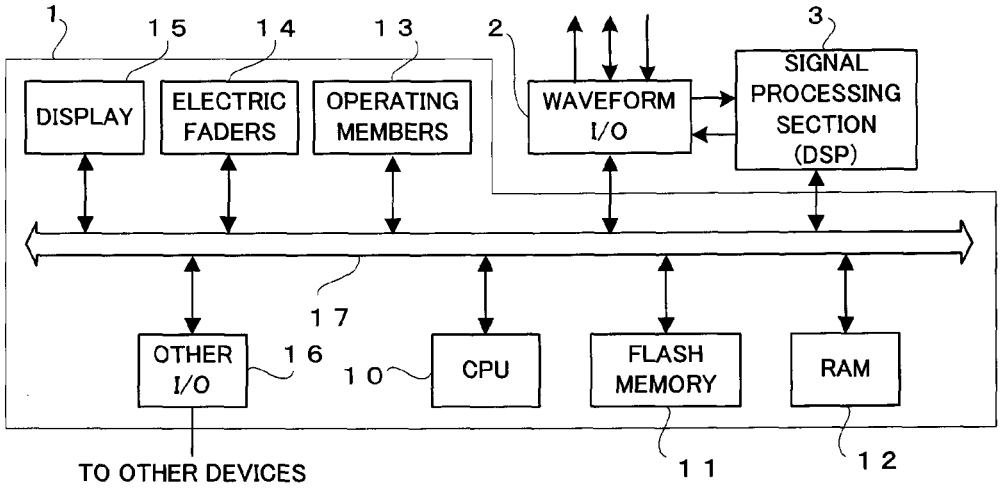
FIG. 1 is a block diagram showing an example hardware setup of a mixing system constructed as an embodiment of the present invention.

FIG. 1 is a block diagram showing an example hardware setup of the mixing system.

The mixing system of FIG. 1 includes: a mixing console 1 that controls overall operation of the mixing system on the basis of operation of a human operator; an input/output device (i.e., "waveform I/O" device) 2 capable of inputting and outputting audio signals of a plurality of channels; and a mixing engine (i.e., signal processing section in the form of a "DSP") 3 that performs mixing processing on audio signals. At least the mixing console 1, the I/O device 2 and the mixing engine 3 are interconnected in such a manner that remote-controlling data can be communicated thereamong, and at least the I/O device 2 and the mixing engine 3 are interconnected in such a manner that digital audio signals can be communicated therebetween. Alternatively, all of the mixing console 1, I/O device 2 and mixing engine 3 may be interconnected in such a manner that remote-controlling data and digital audio signals can be communicated thereamong.

The mixing system comprising the mixing console 1, the I/O device 2 and the mixing engine (DSP) 3 is a digital mixing system that realizes signal processing, such as mixing processing, on audio signals through digital signal processing. Because the mixing console 1, the I/O device 2 and the mixing engine (DSP) 3 constituting the mixing system are devices independent of one another, it is possible to construct a mixing system of an extremely large scale (i.e., having an extremely great number of channels).

The mixing console 1 is an audio control console that includes a plurality of channel strips corresponding to a plurality of channels and that is capable of receiving, for each of the channel strips, a parameter change instruction given by a human operator. The console 1 includes: a control section comprising a CPU 10, a flash memory 11 and a RAM 12; operating members 13; sound level adjusting operating members 14 (e.g., electric faders); a display section 15; and an interface (other I/O) 16, and these components are interconnected via a data and communication bus 17.

The CPU 10 control overall behavior of the console 1 by executing control programs stored in the flash memory 11 or RAM 12. Further, the flash memory 11 includes a current memory storing a current configuration and operating states of the mixing system. Other devices (i.e., engine 3 and I/O device 2) in the mixing system can be controlled via the console 1 on the basis of the stored content of the current memory.

The operating members 13 and the sound level adjusting operating members (electric faders) 14, which are provided on an operation panel of the console 1, include various parameter adjusting operating members provided in a plurality of channel strips. Each of the sound level adjusting operating members 14 is among various operating members provided in one of the channel strips. In the instant embodiment, the sound level adjusting operating members 14 are each in the form of the so-called "electric fader" of which an operating position of a knob portion is electrically controlled on the basis of a drive signal given from the CPU 10. Detection signals generated in response to operation of the operating members 13 and sound level adjusting operating members (electric faders) 14 are supplied via the data and communication bus 17 to the CPU 10, which in turn generates various data based the supplied detection signals.

The display section 15 is, for example, in the form of a liquid crystal display, which displays various information on the basis of display control signals given from the CPU 10 via the bus. The human operator (or user) can make settings of various functions etc. of the mixing system, via screens displayed on the display section 15. Further, peripheral devices, such as a personal computer, can be connected to the console 1 via the other I/O 16. Although not particularly shown and described, the console 1 also includes an audio I/O and a DSP.

The I/O device 2 includes a plurality of analog audio signal input terminals, analog audio signal output terminals and digital audio terminals. The I/O device 2 has a function of an analog input section that converts an analog audio signal, input via each of the input terminals, into a digital signal and supplies the converted digital signal to the engine 3, a function of an analog output section that converts digital audio signals of a plurality of channels, supplied from the engine 3, into analog audio signals and output the converted analog audio signals to the individual output terminals, and a function of a digital input/output section that inputs and outputs digital audio signals via the digital audio terminals. Audio signals from input sources connected to the input terminals and digital audio terminals of the I/O device 2 are supplied to the engine 3 via the I/O device 2. Further, a plurality of audio signals output from the engine 3 are supplied to output destinations connected to respective ones of the output terminals and digital audio terminals of the I/O device 2.

The input sources are some forms of devices, such as a microphone and an audio signal reproduction device, that supply audio signals to the mixing system. Examples of the input sources include a single independent input source for supplying an audio signal of one channel, a pair of input sources for supplying stereo signals of two channels, a set of a predetermined plurality of input sources for supplying surround signals of the predetermined plurality of channels (e.g., 5.1-channel surround signals comprising audio signals of six channels), etc.

Further, the output destinations are some forms of devices, such as a sound system comprising an amplifier and a speaker and an audio recorder, that supply audio signals output from the mixing system. When stereo signals are to be output in a stereophonic manner, or when surround signals are to be output in a surround manner, audio signals of a set of a predetermined number of channels are supplied to a plurality of output destinations corresponding in number to the channels.

The mixing engine (DSP) 3 executes microprograms, on the basis of control data given from the console 1, to perform signal processing, such as mixing processing and effect impartment process, on a plurality of digital audio signals supplied via the I/O device 2 and outputs the resultant processed digital audio signals to the I/O device 2. Details of the signal processing performed by the DSP 3 will be discussed with reference to FIG. 2.

Although not particularly shown, each of the I/O device 2 and engine 3 includes other components, such as a control section including a CPU and a memory, and a simple user interface.

—Construction for the Mixing Processing—

Figure 2:
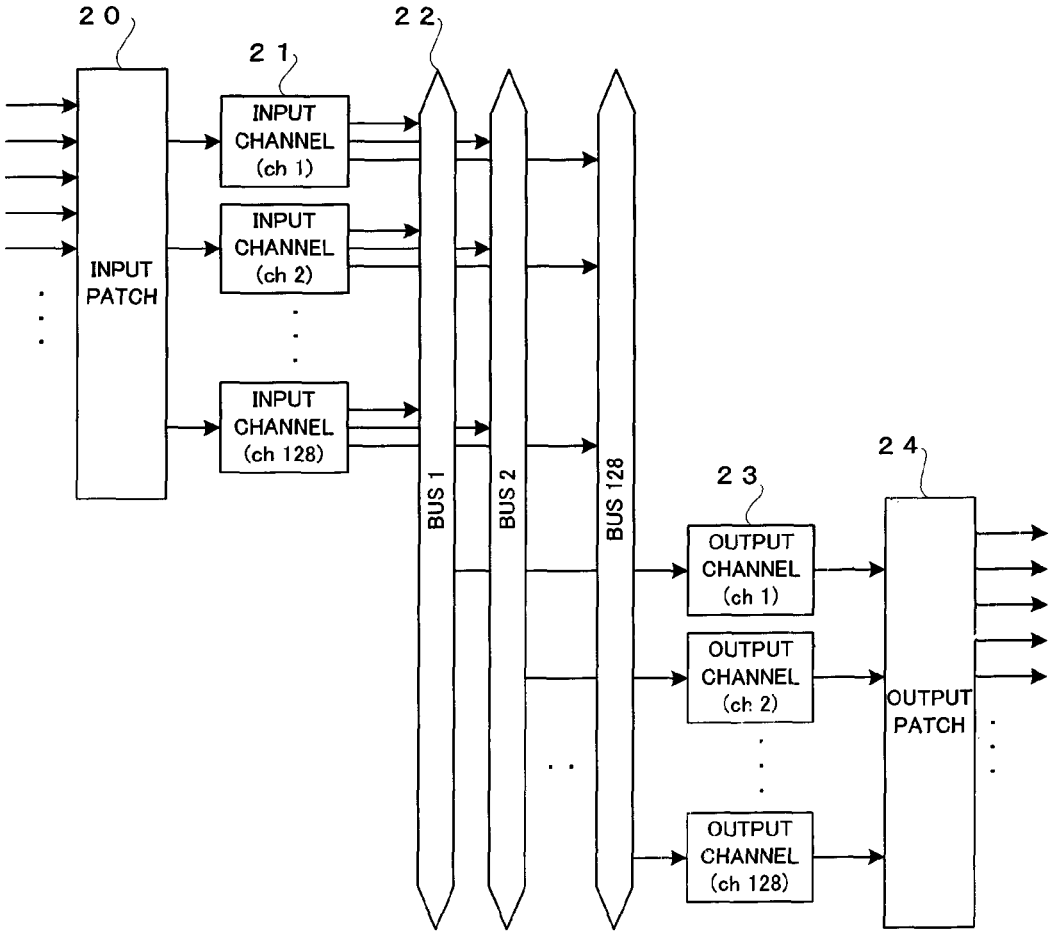
FIG. 2 is a block diagram showing a construction for a mixing processing performed in the mixing system.

FIG. 2 is a block diagram showing a construction for the mixing processing in the mixing system. In the illustrated example of FIG. 2, functions of various components are implemented by microprograms executed by the mixing engine (DSP) 3.

An input patch section 20 makes settings for connecting a plurality of physical input terminals of the I/O device 2 to input channels 21 provided at a succeeding stage (i.e., patch settings between the input sources and the input channels 21). Thus, an audio signal input via any one of the input terminals of the I/O device 2 (i.e., an audio signal from any one of the input sources) is allocated to one of the input channels 21. Note that, although an audio signal from any one of the input sources can be allocated to a plurality of the input channels, audio signals of a plurality of the input sources can not be allocated to only one of the input terminals.

In this specification, the term "patch" is used to mean allocating an audio signal input source to an audio signal supply destination. Setting such a "patch" can connect an audio signal input source and an audio signal supply destination.

In the instant embodiment, the input channels 21 are a predetermined plurality of (e.g., 128 (one hundred and twenty-eight)) logical signal processing channels that are implemented by signal processing of the DSP 3. The 128 (one hundred and twenty-eight) input channels 21 are assigned respective unique channel numbers ("ch1"-"ch128"). To each of the input channels 21 is input an audio signal from one input source (input terminal) that is allocated to that input channel by the input patch section 20. Then, in each of the input channels 21, signal processing is performed on the input audio signal on the basis of various parameter values that are set for the input channel, independently of the other input channels, via the console 1.

Each of the input channels is provided with various parameters, such as head amplifier gain, attenuator, delay, phase switching, equalizer (EQ), compressor, sound volume level, channel-ON/OFF and panning parameters. Of these parameters, the head amplifier gain, attenuator, delay and phase switching parameters can be said to be parameters that are intended for adjustment etc. of sound characteristics of an audio signal input to each of the input channels. The equalizer (EQ), compressor, sound volume level, channel-ON/OFF and panning parameters, on the other hand, can be said to be parameters that are intended for adjustment etc. of sound characteristics of an audio signal output from each of the input channels. The feature that each of the input channels is provided with various parameters for the aforementioned purposes is known per se in the art. Further, the aforementioned parameters provided in each of the input channels are merely illustrative examples and may be other types of parameters.

In the instant embodiment, "channel types" corresponding to the input sources allocated to the input channels 21 are set for the individual input channels 21. The channel types include: a "normal channel" type characterized by handling an audio signal of one input source, as an independent signal, using one input channel; a "stereo channel" type characterized by handling stereo signals of a pair of input sources, while associating them with each other as a pair of signals, using two input channels; and a "surround channel" type characterized by handling 5.1-channel surround signals of a set of six input sources, while associating them with one another as a set of six signals, using six input channels.

In the instant embodiment, there are provided a predetermined plurality of (e.g., 128 (one hundred and twenty-eight)) buses 22 at a stage following the input channels 21, and the 128 buses 22 are assigned respective unique bus numbers ("bus 1"-"bus 128"). Each of the buses 22 mixes together audio signals input thereto and outputs the resultant mixed signal to a corresponding one of a plurality of output channels 23.

For each of the 128 buses 22 is fixedly set any one of three bus types corresponding to the aforementioned three channel types. Namely, a "normal bus" type characterized by using each of the buses 22 as an independent bus is set for 96 (ninety-six) buses of the 128 buses 22. Further, a "stereo bus" type characterized by using two buses 22 as a stereo bus group is set for 20 (twenty) buses of the 128 buses 22. Namely, each stereo bus group comprises two stereo buses, and a total of ten stereo bus groups are provided in the entire mixing system. Furthermore, a "surround bus" type characterized by handling six buses 22 as a single surround bus group is set for 12 (twelve) buses of the 128 buses 22. Namely, two surround bus groups, each comprising six surround buses, are provided in the entire mixing system. The numbers of the buses to be allocated to the individual bus types mentioned above are mere illustrative example and should not be construed as limitative. Further, whereas the embodiment has been described above as fixedly setting the bus types for the individual buses, the present invention is not so limited, and the user may be allowed to set and change the bus types of the individual buses as desired.

The output channels 23 are logical signal processing channels that are implemented by signal processing performed by the DSP 3, and 128 (one hundred and twenty-eight) such output channels 23 are provided in corresponding relation to the 128 buses 22. The output channels 23 are assigned respective unique channel numbers ("ch1"-"ch128"). Each of the output channels 23 performs processing on an audio signal, output from the corresponding bus 22, on the basis of values of various parameters that are set per channel on the console 1.

An output patch section 24 makes settings for connecting the output channels 23 to a plurality of physical output terminals of the I/O device 2 (i.e., patch settings between the output channels 23 and the output terminals). In this manner, an audio signal output from each of the output channels 23 is allocated to one of the output terminals of the I/O device 2. In other words, an audio signal output from each of the output channels 23 is supplied to an output-destination device (e.g., speaker) via one of the output terminals. Note that, although each of the output channels 23 is allocatable to a plurality of the output terminals, audio signals of a plurality of the output channels 23 cannot be allocated to only one of the output terminals.

—Setting of Channel Type—

The human operator (or user) can set any one of "channel types", i.e. "normal channel", "stereo channel" and "surround channel", for each of the 128 (one hundred and twenty-eight) logical input channels. In the instant embodiment, such channel type setting operation is performed collectively for each input channel block comprising a predetermined number of the input channels. Namely, once the user sets a block type for any one of the input channel blocks, the channel types are automatically set for the individual input channels of the input channel block.

The "block type" is a parameter defining a combination of channel types. The "combination of channel types" defines channel types to be allocated to a plurality of the input channels constituting one input channel block, i.e. defines a group configuration of a plurality of the input channels constituting one input channel block.

In the instant embodiment, each of the input channel blocks comprises eight input channels. Thus, in the mixing system, the 128 input channels can be divided into sixteen input channel blocks. More specifically, groups each comprising eight adjoining input channels are sequentially set as input channel blocks, from the first channel of the leading channel number onward (i.e., beginning with the first channel of the leading channel number). For example, the channels of channel Nos. 1-8 are set as one input channel block, the channels of channel Nos. 9-16 are set as another input channel block, and so on. In this case, the human operator only has to set block types for the sixteen input channel blocks, and thus, a human operator's load can be reduced dramatically as compared to a case where the human operator sets a channel type separately for each of the 128 input channels.

The number of the input channels constituting an input channel block is set to be at least equal to or greater than the number of the "surround channels". Because the number of the "surround channels" and the number of the buses constituting the "surround bus group" are normally set to equal each other, the "number of the input channels constituting an input channel block" can be defined as "being at least equal to or greater than the number of the 'surround channels'". It is preferable that the number of the input channels constituting one input channel block be set to correspond to the number of the channel strips (i.e., physical operating members) provide on the operation panel of the console 1. Generally, a predetermined number of physical channel strips smaller than the number of all logical channels owned by a DSP are provided on an operation panel of a console, so that a plurality of the logical channels are called out to the predetermined number of physical channel strips in a predetermined combination. Thus, if the number of the input channels constituting one input channel block be set to correspond to the number of the channel strips, the input channels constituting one input channel block can be collectively called out to the predetermined number of physical channel strips, which thereby allows the human operator to readily recognize or follow a relationship between the channel strips and the input channel block. Further, it is preferable that the number of the input channels constituting one input channel block be eight in that the input channels constituting one input channel block can appropriately respond to a 7.1-channel surround configuration comprising eight channels.

Figure 3:
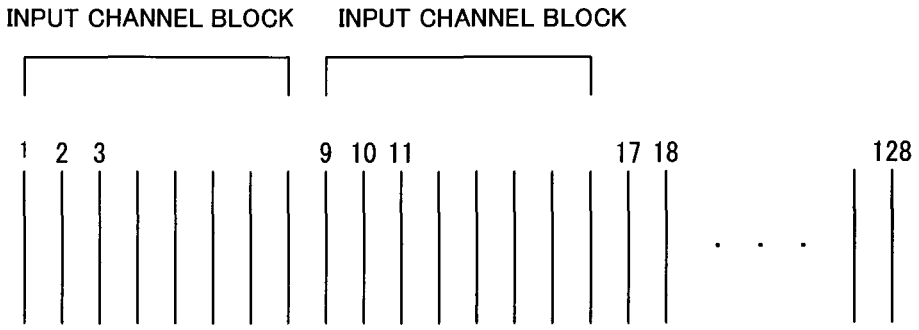
FIG. 3 is a block diagram explanatory of a combination of channel types set for individual input channels of an input channel block in a case where a "normal block" type is set for the input channel block.
Figure 4:
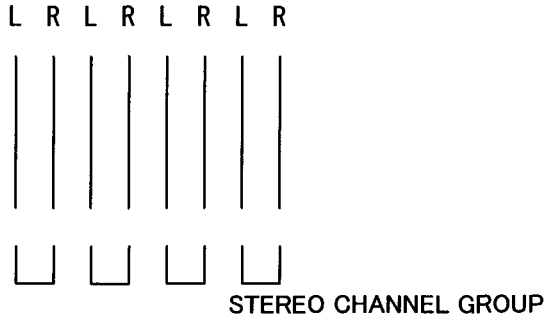
FIG. 4 is a block diagram explanatory of a combination of channel types set for individual input channels of an input channel block in a case where "stereo block" type is set for the input channel block.

FIGS. 3-5 are diagrams explanatory of combinations of channel types set for individual input channels, belonging to an input channel block, when a block type has been set for the input channel block.

—Normal Block—

FIG. 3 is a block diagram explanatory of a combination of channel types set for individual input channels of an input channel block in a case where "normal block" is set as a block type (i.e., where the "normal block" type is set for the input channel block). In FIG. 3 (and FIGS. 4 and 5 as well), vertical lines indicate input channels. When "normal block" has been set as a block type of an input channel block (e.g., channels Nos. ch1-8ch), "normal channel" is set as a channel type for each of the input channels. Each of the input channels, for which the "normal channel" type is set, is controlled independently of the other channels (in a non-parameter-ganging manner). Namely, once the human operator changes a parameter of one channel strip on the console 1, a parameter of only one input channel allocated to that channel strip is controlled.

—Stereo Block—

FIG. 4 is a block diagram explanatory of a combination of channel types set for individual input channels of an input channel block when "stereo block" has been set as a block type. When "stereo block" has been set as a block type of an input channel block (e.g., channels Nos. ch1-8ch), "stereo channel" is set as a channel type for each of the eight input channels constituting the input channel block. Each of the input channels in the input channel block, for which the channel type "stereo channel" has been set, necessarily forms part of a stereo channel group comprising a plurality of (two in the instant embodiment) input channels corresponding to a plurality of (two in the instant embodiment) buses constituting a stereo bus group. In the instant embodiment, the eight input channels constituting the input channel block form four stereo channel groups each comprising two input channels; namely, the four stereo channel groups are made by sequentially pairing the eight input channels in the order of the channel numbers. For example, in the case of the input channel block comprising the input channels of channel Nos. ch1-ch8, each of pairs of the input channels of channel Nos. ch1 and ch2, the input channels of channel Nos. ch3 and ch4, the input channels of channel Nos. ch5 and ch6 and the input channels of channel Nos. ch7 and ch8 form a stereo channel group.

Further, of each of the stereo channel groups, one of the two input channels (e.g., input channel of an odd channel number) is set as a channel for handling a left (L) channel of two input sources that supply two-channel stereo signals, while the other of the two input channels (e.g., input channel of an even channel number) is set as a channel for handling a right (R) channel of the two input sources. In FIG. 4, letters "L" and "R" attached to the vertical lines, indicative of the individual input channels, distinguish between the input sources of the two-channel stereo signals to be handled by the input channels set as above.

In each of the stereo channel groups, the two input channels (for which the "stereo channel" type is set) both become parameter-ganging channels, so that one or some of parameters of the two input channels are controlled in ganged relation to each other. Namely, once the human operator gives an instruction, on the console 1, for changing a parameter of a channel strip to which is allocated an input channel, set as a component channel of a stereo channel group, one or some of the input channel allocated to the channel strip and one or some of parameters of the other input channel of a same stereo channel group as that input channel are controlled in ganged relation to each other. Thus, the instant embodiment can control parameters of two input channels, having two audio signals allocated thereto, while still maintaining a stereophonic relationship set in advance for the audio signals supplied from two stereo input sources. Note that the individual stereo channel groups are controlled independently of each other.

As noted above, each of the input channels is provided with various parameters, such as head amplifier gain, attenuator, delay, phase switching, equalizer (EQ), compressor, sound volume level, channel-ON/OFF, panning and other parameters. Of these parameters, parameters to be controlled in ganged relation in input channels are the equalizer (EQ) parameter, compressor parameter, sound volume level parameter and channel-ON/OFF parameter. Further, a balance parameter for setting left-and-right sound volume balance between the two input channels of the stereo channel group is also among the parameters to be controlled simultaneously in ganged relation in the two input channels. Note that these parameters to be controlled in ganged relation in a plurality of the input channels are parameters intended to adjust sound characteristics of signals to be output from the input channels to buses. On the other hand, the head amplifier gain parameter (and other parameter pertaining to the head amplifier), attenuator parameter, delay parameter and phase switching parameter are not ganged in a plurality of the input channels. Note that these parameters not to be controlled in ganged relation between a plurality of the input channels are parameters intended to adjust sound characteristics of signals to be output from input source to the input channels.

—Surround Block—

Figure 5A:
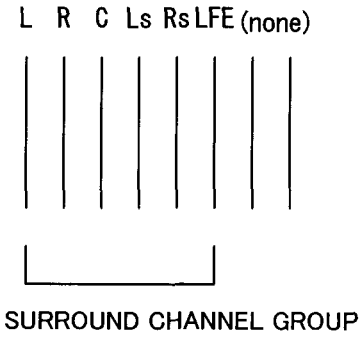
Figure 5B:
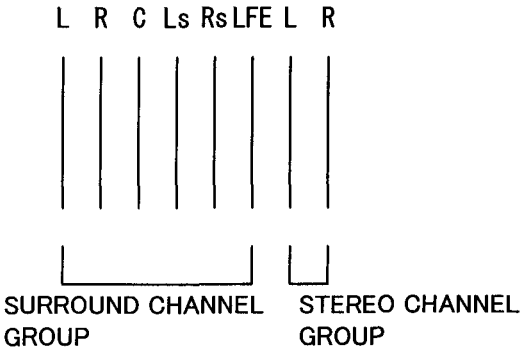

FIGS. 5A and 5B are block diagrams explanatory of combinations of channel types set for individual input channels of an input channel block in a case where "surround block" type is set as a block type. In the instant embodiment, the human operator can select, as the surround block, either a first surround block shown in FIG. 5A or a second surround block shown in FIG. 5B.

Once the first surround block type shown in FIG. 5A is selected, six of the eight input channels constituting the input channel block are sequentially set as surround channels in the order of their channel numbers, to thereby form a surround channel group of the six input channels. The remaining two input channels are each set as a normal channel.

Once the second surround block shown in FIG. 5B is selected, on the other hand, six of the eight input channels constituting the input channel block are sequentially set as surround channels in the order of their channel numbers, to thereby form a surround channel group of the six input channels. The remaining two input channels are each set as stereo channels to form a stereo channel group.

In a later-described block type setting process, the input channels, having been set as the surround channels as above, necessarily form a "surround channel group" comprising a plurality of (six in the instant embodiment) input channels corresponding to a plurality of (six in the instant embodiment) buses constituting a surround bus group. As seen from the foregoing, a difference between the first surround block shown in FIG. 5A and the second surround block shown in FIG. 5B is whether the two input channels, other than those of the surround channel group, in the input channel block are set as normal channels or set as stereo channels.

Further, signals of six input sources, i.e. left front (L), right front (R), center front (C), left rear (Ls), right rear (Rs) and low-pitched-sound subwoofer (LFE (Low Frequency Effects)), are set for respective ones of the six input channels, having been set as a surround channel group, as surround signals to be handled by the respective input channels. In the instant embodiment, the six input channels belonging to the surround channel group are sequentially set as "L", "R", "C", "Ls", "Rs" and "LFE" channels, respectively, in an increasing order of their channel numbers. In FIGS. 5A and 5B, letters "L", "R", "C", "Ls", "Rs" and "LFE" attached to the vertical lines indicative of the input channels distinguish among input sources of surround signals handled by the individual input channels, namely, distinguish among the L, R, C, Ls, Rs and LFE channels.

Of the six input channels set as a surround channel group, the input channels handling signals of the "L", "R", "C", "Ls" and "Rs" input sources function as "parameter-ganging channels" that, in response to change operation by the human operator, change their corresponding parameter in ganged relation in the channels. Further, of the six input channels set as a surround channel group, the input channel handling a signal of the "LFE" input source functions as a "non-parameter-ganging channel" that does not change a parameter in ganged relation to the other input channels of the same group. Parameter change may be automatically instructed, for example, in accordance with performance sequence data, rather than in response to operation by the human operator.

Note that parameters to be controlled in ganged relation in the parameter-ganging channels "L", "R", "C", "Ls" and "Rs" are those which are intended to adjust sound characteristics of signals to be output from the input channels to buses, such as the equalizer (EQ) parameter, compressor parameter, sound volume level parameter, channel-ON/OFF parameter, etc., as with the aforementioned stereo channels. Further, types of parameters to be not controlled in ganged relation in the parameter-ganging channels are those which are intended to adjust sound characteristics of signals to be input from the input source to the input channel, such as the head amplifier gain parameter (and other parameter pertaining to the head amplifier), attenuator parameter, delay parameter, phase switching parameter, etc., as with the aforementioned stereo channels.

In a case where "surround channel" is set as a channel type, the six input channels constituting a surround channel group are controlled in association with one another. Namely, as will be detailed later, if an input channel for which the human operator has given a parameter change instruction is one of the above-mentioned "parameter-ganging channels", then the values of the parameter in all the parameter-ganging channels ("L", "R", "C", "Ls" and "Rs") within the surround channel group, to which that input channel belongs, are controlled on the basis of the parameter change instruction of the human operator. If, on the other hand, the input channel for which the human operator has given a parameter change instruction is the "non-parameter-ganging channel" ("LFE"), then only the value of the parameter of the input channel "LFE" is controlled on the basis of the parameter change instruction of the human operator.

In FIG. 5A, the normal channels (two right-side input channels in the figure) that do not belong to the surround channel group are controlled independently of each other in the same manner as the input channels shown in FIG. 3. Needless to say, the surround channel group and the normal channels in FIG. 5A are controlled independently of each other. Further, in FIG. 5B, the stereo channels (two right-side input channels in the figure) that do not belong to the surround channel group are controlled as one stereo channel group, in the same manner as shown and described in FIG. 4, so that a parameter is controlled simultaneously or in ganged relation in the stereo channels. Further, the surround channel group and the stereo channels in FIG. 5B are controlled independently of each other.

—Block Type Setting Screen—

Figure 6:
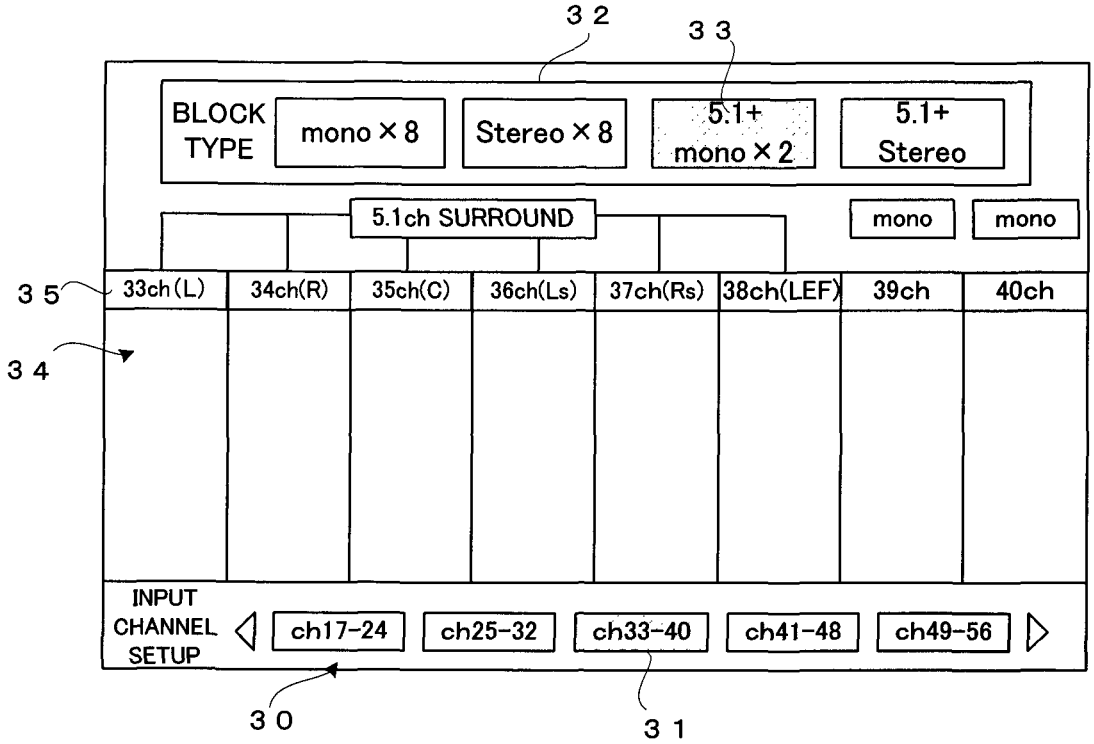
FIG. 6 is a diagram showing an example of an input channel block type setting screen displayed on a display section of a console in the mixing system.

The human operator can make block type settings, explained above with reference to FIGS. 3-5, via screens displayed on the display section 15 of the console 1. FIG. 6 is a diagram showing an example of an input channel block type setting screen displayed on the display section 15 of the console 1. The block type setting screen of FIG. 6 is displayed on the display section 15 once the human operator activates a block type setting mode which is one of various setting functions pertaining to input channels.

As shown in FIG. 6, a channel block selection portion 30 is provided in a lower end region of the input channel block type setting screen, which includes a plurality of block selection buttons 31 provided in corresponding relation to sixteen input channel blocks formed by dividing the 128 input channels every eight channels. In the channel block selection portion 30, only five block selection buttons 31 are displayed at a time, and the block selection buttons 31 appearing on the screen can be changed by scrolling the screen. The human operator can select an input channel block to be displayed on the screen, by selecting any one of the block selection buttons 31. Once selected by the human operator, a display style of the thus-selected block selection button 31 is changed to clearly indicate a selected state. In the illustrated example, the selected block selection button 31 is displayed in a shaded display style.

A block type selection section 32, which is provided in an upper-end region of the input channel block type setting screen, includes four block type selection buttons 33 that correspond to the "normal block", "stereo block", "first surround block" and "second surround block". By operating any one of the block type selection buttons 33, the human operator can select one of the "normal block", "stereo block", "first surround block" and "second surround block" types to be set for the input channel block currently selected via the block selection button 31. The thus-selected block type selection button 33 is changed to a display style (shaded display style) different from the non-selected block type selection buttons 33; thus, the currently-selected block type selection button 33 can be clearly indicated by the different display style.

In a channel display section 34, which is provided in an intermediate region of the input channel block type setting screen, are displayed channel buttons 35 that correspond to the eight input channels belonging to the input channel block currently selected via the block selection button 31. Each of the channel buttons 35 indicates a channel number of the input channel and a type of an input source. The "type of an input source" is one of "L" and "R" if the input channel in question is one whose channel type is "stereo channel", or one of "L", "R", "C", "Ls", "Rs" and "LFE" if the input channel in question is one whose channel type is "surround channel". Let it be assumed here that, if the input channel in question is one whose channel type is "normal channel", no input source type is displayed. Further, although not particularly shown, other information, such as the name of the input source (or signal, musical instrument or the like) allocated to the input channel in question may be displayed on each of the channel buttons 35.

Once the "first surround block" type is selected by operation of one of the block type selection buttons 33, lines interconnecting the six channel buttons 35, corresponding to the six input channels set as a surround channel group, and a character string "5.1-Channel Surround" are displayed immediately above the corresponding channel buttons 35 in the channel display portion 34, so as to clearly indicate that these six input channels are forming one surround channel group. No particular display is necessary for the remaining two input channels because these two are normal channels. FIG. 6 shows a state where the "first surround block" type has been selected.

Although not particularly shown, once the "second surround block" type is selected by operation of one of the block type selection buttons 33, a surround channel group is displayed immediately above the corresponding channel buttons 35, corresponding to the six input channels set as a surround channel group, in a similar display style to that shown in FIG. 6. The remaining two input channels are set as a stereo channel group, and thus, a line interconnecting the corresponding two channel buttons 35 and a letter string "Stereo" are displayed, immediately above the corresponding two channel buttons 35, to clearly indicate that these input channels constitutes a stereo channel group.

—Block Type Setting—

Figure 7:
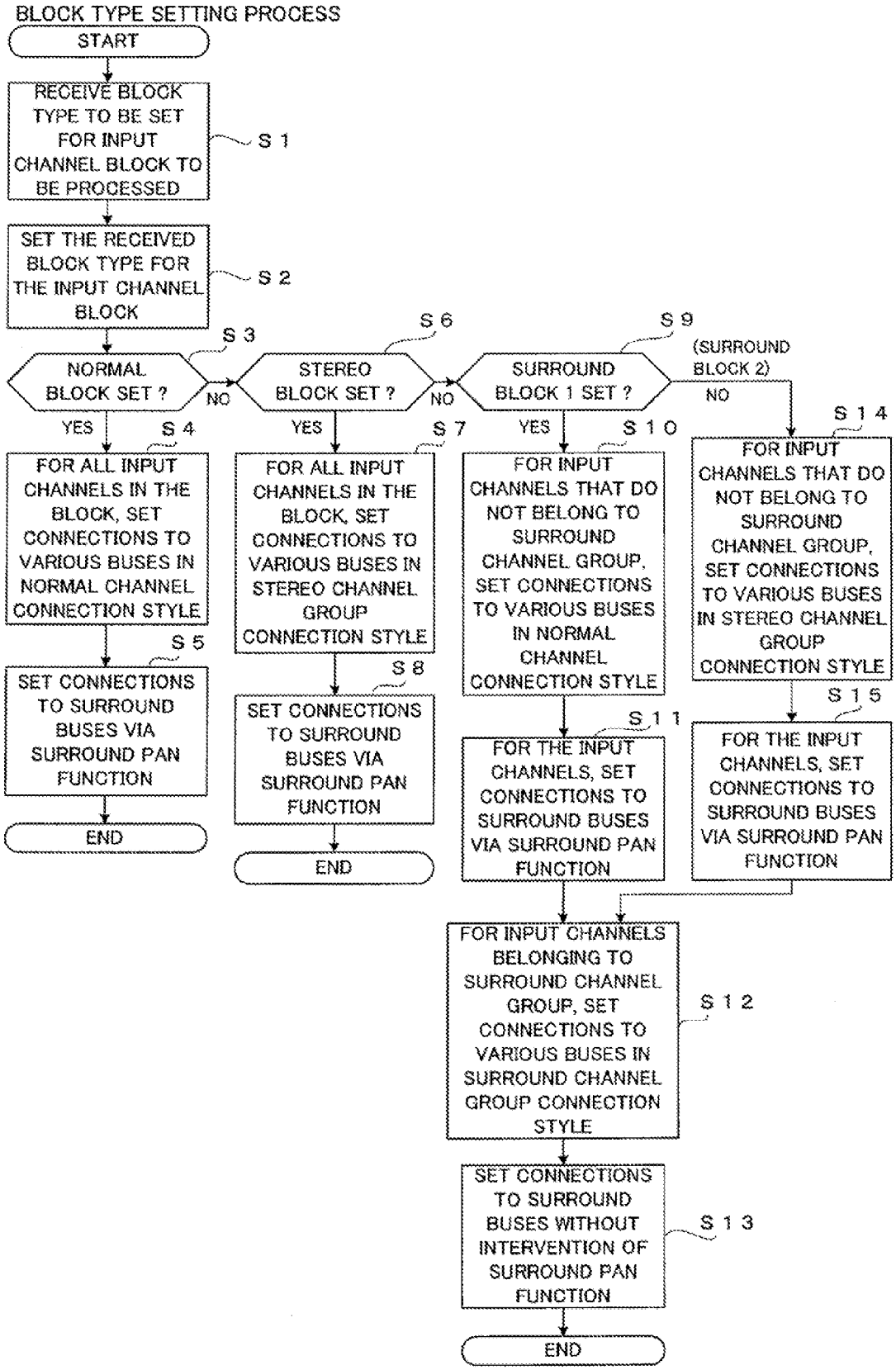
FIG. 7 is a flow chart showing an example operational sequence of a process for setting a block type.

FIG. 7 is a flow chart showing an example operational sequence of a process performed by the CPU 10 of the console 1 for setting a block type. This process is started up once the screen of FIG. 6 is displayed on the display section 15 in response to the human operator activating the block type setting mode. The process of FIG. 7 will be described as performed on one input channel block. Thus, it should be appreciated that, in order to set block types for all of the input channel blocks provided in the mixing system (DSP 3), the process of FIG. 7 is performed on all of the input channel blocks.

On the screen of FIG. 6, the human operator selects any one of the four block type selection buttons 33 to designate a block type to be set for the input channel block to be processed. At step S1, the CPU 10 of the console 1 receives the block type designated by the human operator.

At next step S2, the CPU 10 of the console 1 stores the block type, received at step S1 above, into the flash memory 11 or RAM 12 as a block type set for the input channel block to be processed. Further, on the basis of a combination of channels types defined by the set block type, the CPU 10 of the console 1 sets channel types for individual ones of the eight input channels belonging to the input channel block to be processed, and stores, into the flash memory 11 or RAM 12, a relationship between the individual input channels and the set channel types.

Further, for input channels for which "stereo channel" has been as the channel type in the aforementioned manner, the CPU 10 sets a stereo channel group comprising two input channels. Then, the CPU 10 sets input source types ("L" and "R" types) for the individual input channels belonging to the thus-set stereo channel group and sets each of the channels, belonging to the stereo channel group, as a parameter-ganging channel. These set relationships (i.e., settings of the "stereo channel group", "input source types" and "parameter-ganging channels" for the input channels) are stored into the flash memory 11 or RAM 12.

Furthermore, for the input channels for which "surround channel" has been as the channel type, the CPU 10 sets a surround channel group comprising six input channels. Then, the CPU 10 sets input source types "L", "R", "C", "Ls", "Rs" and "LFE" for the individual input channels belonging to the surround channel group, and it sets all of these input channels, for which "L", "R", "C", "Ls" and "Rs" have been set as the input source types, as "parameter-ganging channels" and sets the remaining input channel (i.e., input channel for which "LFE" has been set as the input source type) as a "non-parameter-ganging channel". These set relationships (i.e., settings of the "surround channel group", "input source types" and "parameter-ganging channels" for the input channels) are stored into the flash memory 11 or RAM 12. Namely, when "first surround block" or "second surround block" has been selected as the block type, the CPU 10 sets, as a surround channel group, predetermined six of the input channels of the input channel block to be processed and sets at least one of the input channels, belonging to the surround channel group, as a non-parameter-ganging channel, through the operation of step S2.

Then, the CPU 10 proceeds to step S3, where it sets connections between all of the input channels belonging to the input channel block and various buses in accordance with the channel types set at step S2. Further, the CPU 10 transmits control data, indicative of the thus-set connections, to the engine (DSP) 3 in order to remote-control connections between the input channels and the various buses 22 owned by the engine (DSP) 3. In turn, the DSP 3 sets connections between the input channels and the various buses 22. "setting connections between the input channels and the buses 22" here means setting buses capable of outputting signals from the input channels and buses incapable of outputting signals from the input channels. Setting the buses so as to be capable of outputting signals from the input channels will hereinafter be referred to as "connect" or "connecting"; more specifically, such "connecting" means providing lines for sending a signal from one of the input channels to corresponding ones of the buses within the DSP. On the other hand, setting the buses so as to be incapable of outputting signals from the input channels will hereinafter be referred to as "not connect" or "non-connecting"; more specifically, such "non-connecting" means not providing a line for sending a signal from one of the input channels to one of the buses within the DSP. This kind of setting is different from settings that use parameters of send-level and channel-ON/OFF from one of the input channels to the various buses 22. For each bus 22 having been set as "connecting", it is possible to set, using the send-level and channel-ON/OFF parameters, whether or not a signal should be output from the input channel in question to the bus 22. For each bus 22 having been set as "non-connecting", on the other hand, no signal can be output from the input channel in question to the bus 22, regardless of settings of the send-level and channel-ON/OFF parameters.

—In the Case of the Normal Block—

Figure 8:
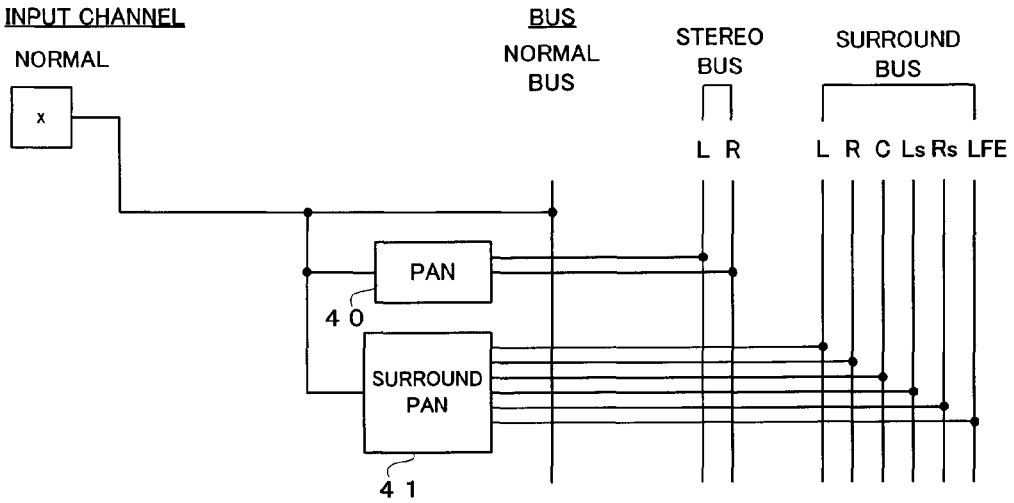
FIG. 8 is a block diagram explanatory of a connection style between an input channel and various buses in a case where a "normal channel" type is set for an input channel block.

When the "normal block" type has been set at step S2 (YES determination at step S3), the CPU 10 of the console 1 sets connections between all of the input channels (i.e., eight input channels) belonging to the input channel block in question and the normal buses and connections between all of the input channels and the stereo buses, in a normal channel connection style shown in FIG. 8 (step S4). Further, the CPU 10 of the console 1 sets connections between all of the input channels belonging to the input channel block and the surround buses, in a normal channel connection style (i.e., style in which the connections are made via a surround pan function) shown in FIG. 8 (step S5).

FIG. 8 is a block diagram explanatory of a connection style (normal channel connection style) in which an input channel ("X"), for which the "normal channel" is set, and the various buses are connected. In the illustrated example of FIG. 8, only one stereo bus group (i.e., two stereo buses) is shown along with only one surround bus group (i.e., six surround buses), for simplicity of illustration.

In FIG. 8, one input channel (X) is shown as connected to one normal bus, although, in practice, the input channel (X) is connected to all of the ninety-six normal buses. Further, in FIG. 8, the input channel (X) is connected to two stereo buses (L and R buses), constituting one stereo bus group, via a stereo pan setting section ("Pan") 40. More specifically, the stereo pan setting section 40 includes two output lines corresponding to the L (left) and R (right) channels, and these output lines of the stereo pan setting section 40 are connected to the corresponding stereo buses. An signal of the input channel (X) is distributed to the two output lines via the stereo pan setting section 40 and then supplied to the stereo (L and R) buses via the two output lines. Pan values of the signals sent from the input channel to the two stereo buses are adjusted in accordance with values of a parameter (pan) of the stereo pan setting section 40.

Further, in FIG. 8, the input channel (X) is connected to individual ones of six surround buses (L, R, C, Ls, Rs and LFE) constituting one surround bus group via a surround pan setting section ("Surround Pan") 41. More specifically, the surround pan setting section 41 includes six output lines corresponding to the L, R, C, Ls, Rs and LFE surround buses, and these six output lines are connected to the L, R, C, Ls, Rs and LFE surround buses, respectively. The signal of the input channel (X) is distributed to the six output lines via the surround pan setting section 41 and then supplied to the six surround buses (L, R, C, Ls, Rs and LFE surround buses). Pan values of the signals sent from the input channel to the six surround buses are adjusted in accordance with values of a parameter (surround pan) of the surround pan setting section 41.

—In the Case of the Stereo Block—

Figure 9:
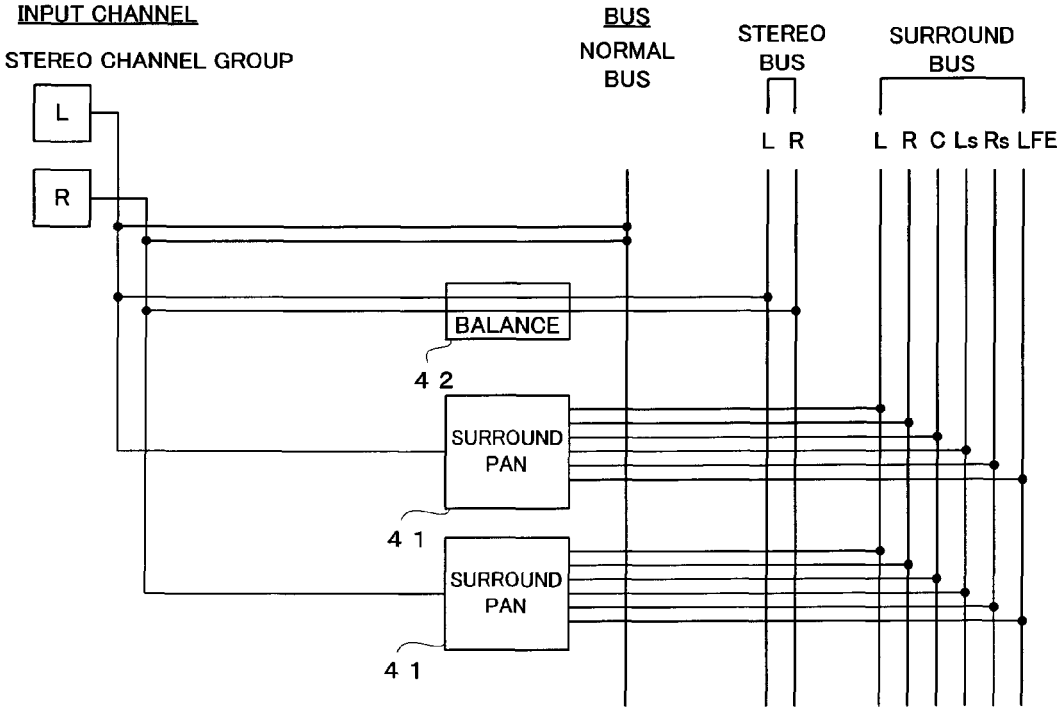
FIG. 9 is a block diagram explanatory of a connection style between input channels belonging to a stereo channel group and various buses in a case where a "stereo channel" type is set for an input channel block.

When the "stereo block" type has been set at step S2 (NO determination at step S3 and YES determination at step S6), the CPU 10 of the console 1 goes to step S7, where it sets connections between all of the input channels (i.e., eight input channels) of the input channel block and the normal buses and connections between all of the input channels and the stereo buses, in a stereo channel group connection style shown in FIG. 9. Further, the CPU 10 of the console 1 sets connections between all of the input channels of the input channel block and the surround buses, in a stereo channel group connection style (i.e., style in which the connections are made via a surround pan function) shown in FIG. 9.

FIG. 9 is a block diagram explanatory of the connection style (stereo channel group connection style) in which two stereo input channels (L and R) belonging to a same stereo channel group and the various buses in the case where the "stereo channel" type is set for an input channel. The buses shown in FIG. 9 are similar in configuration to those shown in FIG. 8.

As shown in FIG. 9, the two stereo input channels (L and R) of the stereo channel group are both connected to a same normal bus, so that signals of the two stereo input channels (L and R) are mixed via the normal bus. Further, the two stereo input channels (L and R) of the stereo channel group are connected exclusively to corresponding ones of two stereo buses (L and R) of a stereo bus group. Namely, one of the stereo input channels, for which "L" is set as the input source type, is connected only to the stereo bus "L" (i.e., not connected to the stereo bus "R"), while the other of the stereo input channels, for which "R" is set as the input source type, is connected only to the stereo bus "R" (not connected to the stereo bus "L"). Further, the two stereo input channels (L and R) are connected to the six surround buses constituting one surround bus group. Namely, each of the two stereo input channels is connected to the six surround buses via the surround pan setting section 41.

—Balance Parameter—

In the case where the "stereo channel" type is set as for an input channel, as shown in FIG. 9, one balance setting section 42 is inserted, for two stereo channels set as a stereo channel group, at a stage preceding the stereo bus group. The balance setting section 42 is a module for adjusting sound volume levels of the two stereo input channels (L and R channels) of the stereo channel group. Sound image localization (pan position) attained when two signals of the two stereo input channels are reproduced stereophonically can be changed by sound volume levels of the L and R channels being adjusted in accordance with values of the balance parameter of the balance setting section 42. Because signals input to the two stereo input channels (L and R channels) of the stereo channel group are stereo signals adjusted in advance to provide preset stereo localization between the two signals (i.e., stereo signals presenting a predetermined mutual relationship between two input sources), parameter values of the balance setting section 42 adjust sound volume levels of the two input channels to adjust the preset stereo localization. Note that the parameter values of the balance setting section 42 are indicative of a sound volume level ratio between the two input channels.

—In the Case of the First Surround Block—

When the "first surround block" (surround block 1) type has been set at step S2 above (NO determination at step S3, NO determination at step S6 and YES determination at step S9), two input channels that do not belong to a surround channel group in the input channel block in question become normal channels, as shown in FIG. 5A. Thus, at step S10, the CPU 10 of the console 1 sets connections between the two input channels that do not belong to the surround channel group and the normal bus and between the two input channels and the stereo buses in a normal channel connection style through an operation similar manner to step S4. At next step S11, the CPU 10 sets connections between the two input channels that do not belong to the surround channel group and the surround buses in a normal channel connection style (i.e., style in which the connections are made via a surround pan function).

Figure 10:
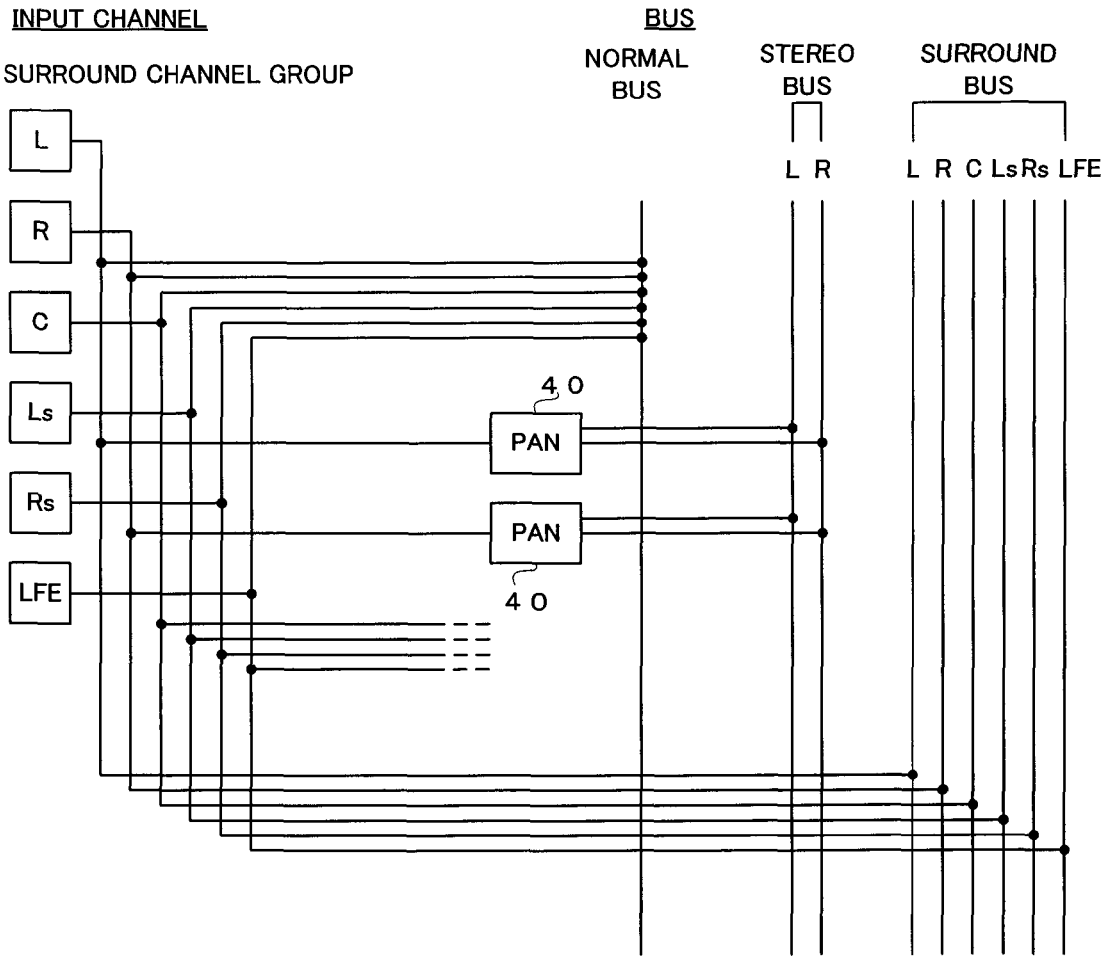
FIG. 10 is a block diagram explanatory of a connection style between input channels belonging to a surround channel group and various buses in a case where a "surround channel" type is set for an input channel block.

Further, at step S12, the CPU 10 of the console 1 sets connections between the six input channels, belonging to the surround channel group in the input channel block in question, and the normal bus and between the six input channels and the stereo bus group in a surround channel group connection style shown in FIG. 10. At next step S13, the CPU 10 of the console 1 sets connections between the six input channels, belonging to the surround channel group in the input channel block in question, and the surround buses in a surround channel group connection style shown in FIG. 10.

FIG. 10 is a block diagram explanatory of the connection style (surround channel group connection style) in which the six input channels (L, R, C, Ls, Rs and LFE), belonging to one surround channel group, and the various buses are connected in a case where the "surround channel" type is set for an input channel. The buses shown in FIG. 10 are similar in configuration to those shown in FIG. 8.

As shown in FIG. 10, all of the six input channels (L, R, C, Ls, Rs and LFE), belonging to the surround channel group, are connected to the same normal bus, so that signals of the six input channels are mixed via the normal bus. Further, the six input channels (L, R, C, Ls, Rs and LFE) are each connected to the stereo buses in a similar connection style to the normal input channel of FIG. 8; namely, each of the six input channels is connected to the two stereo buses of the stereo bus group via the stereo pan setting section 40. Although, in the illustrated example of FIG. 10, only two input channels (i.e., L and R input channels) are shown as connected to the two stereo buses via the stereo pan setting section 40, each of the other input channels (C, Ls, Rs and LFE) is also connected to the two stereo buses via the stereo pan setting section 40.

Further, the six input channels (L, R, C, Ls, Rs and LFE), belonging to the surround channel group, are connected exclusively to corresponding ones of the six surround buses (L, R, C, Ls, Rs and LFE) constituting a surround bus group. Namely, the input channel for which "L" is set as the input source type is connected only to the surround bus "L" (not connected to the other five surround buses "R", "C", "Ls", "Rs" and "LFE"). Similarly, the input channel for which "R" is set as the input source type is connected only to the surround bus "R" (not connected to the other five surround buses "L", "C", "Ls", "Rs" and "LFE"). Further, the input channel for which "C" is set as the input source type is connected only to the surround bus "C" (not connected to the other five surround buses "L", "R", "Ls", "Rs" and "LFE"). The input channel for which "Ls" is set as the input source type is connected only to the surround bus "Ls" (not connected to the other five surround buses "L" "R", "C", "Rs" and "LFE"). The input channel for which "Rs" is set as the input source type is connected only to the surround bus "Rs" (not connected to the other five surround buses "L" "R", "C", "Ls" and "LFE"). Further, the input channel for which "LFE" is set as the input source type is connected only to the surround bus "LFE" (not connected to the other five surround buses "L" "R", "C", "Ls" and "Rs").

As set forth above, signals of the six input sources of "L", "R", "C", "Ls", "Rs" and "LFE", constituting the 5.1-channel surround configuration, are set as signals to be handled by the six input channels "L", "R", "C", "Ls", "Rs" and "LFE" belonging to the surround channel group in the input channel block for which the first surround block has been set. Because the individual input channels of the surround channel group are connected to the corresponding surround buses, 5.1-channel surround signals can be taken out from the six output channels corresponding to the surround buses.

In the case where the "surround channel" type is set for an input channels (i.e., where the "sound block" type is selected), as clearly seen in FIG. 10, the connection style between the individual input channels and the surround buses in FIG. 10 is different from the connection style of FIG. 8 (i.e., conventionally-known surround mode setting) in that each of the input channels is connected to one surround bus according to the connection style of FIG. 10 while each of the input channels is connected to the six surround buses of one surround bus group according to the connection style of FIG. 8. Further, according to the surround channel group connection style shown in FIG. 10, signals presenting a predetermined mutual relationship between six input sources (i.e., surround signals of a set of six input channels preset to achieve sound image localization (surround pan position) in the 5.1-channel surround configuration) are input to individual one of the six surround buses of the surround bus group in a one-to-one relationship, and thus, no surround pan setting section 41 is inserted between the input channels and the surround buses.

As shown in FIG. 10, the instant embodiment is arranged in such a manner that, in the case where the "surround channel" type is set for the input channel, no balance setting section 42 is inserted between the input channels and the surround buses so that a surround pan position setting preset for surround signals of a set of six channels is not adjusted. However, the present invention is not so limited, and balance setting sections 42 may be inserted in lines of the input channels "L", "R", "C", "Ls" and "Rs" that are parameter-ganging channels. In this case, a mutual sound volume relationship among the input channels "L", "R", "C", "Ls" and "Rs" is adjusted in accordance with values of the balance parameter of the balance setting section 42. The reason why the input channel "LFE" is excluded here is that the LFE (subwoofer) is a non-parameter-ganging channel. Setting of sound image localization (surround pan position) is not important to the "LFE" (subwoofer) channel because of the nature of the "LFE" (subwoofer), and there is no relationship pertaining to sound image localization between the "LFE" (subwoofer) channel and the other input channels.

—In the Case of the Second Surround Block—

When the "second surround block" (surround block 2) type has been selected at step S2 (NO determination at step S3, NO determination at step S6 and NO determination at step S9), the two input channels that do not belong to the surround channel group in the input channel block in question become stereo channels constituting one stereo channel group as shown in FIG. 5B. At step S14 of FIG. 7, the CPU 10 of the console 1 sets connections between the two input channels that do not belong to the surround channel group and the normal bus and between the two input channels and the stereo buses in a stereo channel group connection style through an operation similar to step S7. At next step S15, the CPU 10 sets connections between the two input channels that do not belong to the surround channel group and the surround buses in a stereo channel group connection style (i.e., style in which the connections are made via the surround pan function), through an operation similar to step S8. Further, at steps S12 and S13, the CPU 10 of the console 1 sets connections between the six input channels, belonging to the surround channel group in the input channel block in question, and the normal bus and between the six input channels and the surround buses in the surround channel group connection style shown in FIG. 10.

By setting a block type for each input channel block as noted above, the instant embodiment can set, in accordance with the set block type, connections between the individual input channels of the input channel block and the buses. Thus, in the case where "surround block" has been set as the block type, six input channels in the input channel block become surround channels constituting a surround channel group. The six surround channels of the surround channel group are connected in a one-to-one relationship to six surround buses (belonging to a surround bus group). Namely, the CPU 10 of the console 1 functions as a connection section that connects each of the input channels of the surround channel group to a different one of the buses belonging to the surround bus group.

Thus, by merely setting a plurality of input channels, to which are allocated signals of a set of input sources (e.g., 5.1-channel surround signals comprising audio signals of six channels), as a surround channel group, the surround signals of a set of six channels can be taken out from output destinations corresponding to the six surround buses (e.g., can be output from speakers of a plurality of surround reproducing channels) on a channel-by-channel basis.

—Parameter Change—

Figure 11:
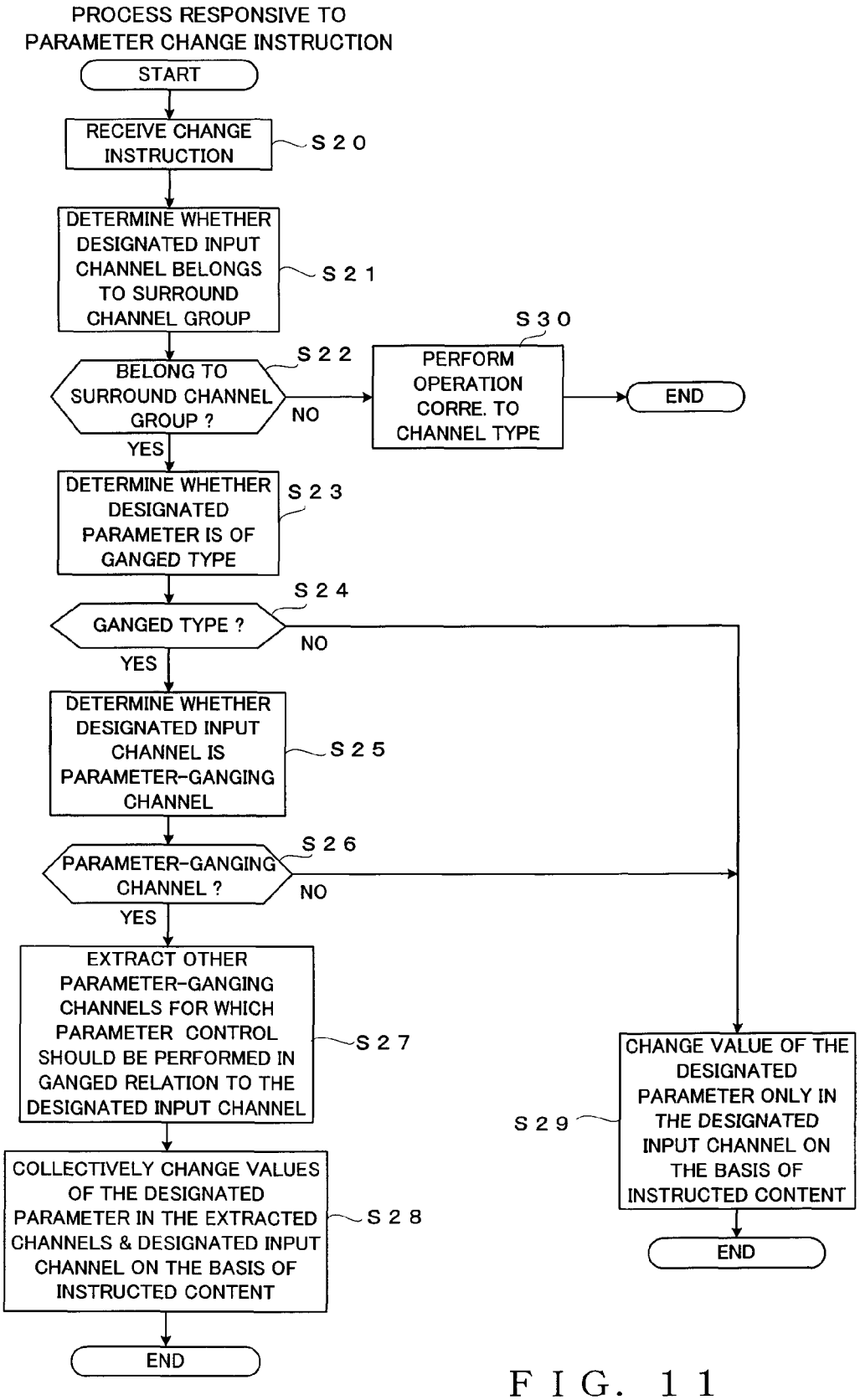
FIG. 11 is a flow chart showing an example operational sequence of a process performed when a change instruction has been given for changing a value of a parameter in an input channel belonging to a surround channel group.

The following describe behavior of the instant embodiment when the human operator has entered a change instruction for changing a value of a parameter of an input channel in an input channel block for which the first or second surround block type is set. FIG. 11 is a flow chart showing an example operational sequence of a process performed when the CPU 10 of the console 1 has received a change instruction for changing a value of a parameter of an input channel. More specifically, the process of FIG. 11 is started up when any of the operating members 13 and 14 of any one of the channel strips has been operated on the console 1, when a change of a value of a parameter of the input channel has been instructed by use of any of GUIs (Graphic User Interfaces) including the display section 15, when a change of a value of a parameter of an input channel has been instructed from an external device, such as a PC, connected to the console 1 via the other I/O 16, or the like. First, at step S20, the CPU 10 receives a change instruction for changing a value of a parameter of an input channel.

At step S21, the CPU 10 of the console 1 determines, on the basis of the relationship between the input channels and the channel types stored in the memory (flash memory 11 or ROM 12) at step S2 above, whether or not the input channel designated as an object to be processed in response to the change instruction (hereinafter referred to as "designated input channel") belongs to a surround channel group, i.e. whether or not "surround channel" is set as the channel type for the input channel. If the designated input channel belongs to a surround channel group (YES determination at step S22), the CPU 10 of the console 1 goes to step S23 in order to further determine whether the parameter to be changed in response to the change instruction (hereinafter referred to as "designated parameter") is a ganged type parameter.

Of various types of parameters provided for the input channels, the "ganged type parameter" is, as noted above, basically intended for adjustment of sound characteristics of a signal to be output from the input channel in question to buses (i.e., output characteristics of the signal to be output from the input channel); more specifically, examples of such a ganged type parameter include equalizer (EQ), compressor, sound volume level, channel-ON/OFF, etc. On the other hand, the "non-ganged type parameter" is, as noted above, basically intended for adjustment of sound characteristics of a signal to be input from an input source to the input channel (i.e., input characteristics of the signal to be input to the input channel); more specifically, examples of such a non-ganged type parameter include head amplifier gain (and other parameter pertaining to the head amplifier), attenuator, delay, phase switching, etc. The ganged type parameters and the non-ganged type parameters employed in the instant embodiment may be similar to those employed in a conventionally-known stereo pair function where a ganged type parameter operates in a ganged (interlocked) manner in paired input channels and a no-ganged type parameter operates in a non-ganged manner in paired input channels. Note that the ganged and non-ganged parameter types employed in the instant embodiment are not limited to the aforementioned examples.

If the designated parameter to be changed in value this time is of the "ganged type" (YES determination at step S24), the CPU 10 of the console 1 goes to step S25, where it determines, on the basis of a relationship between input channels and parameter-ganging/parameter-non-locking channels stored in the memory (flash memory 11 or ROM 12), whether the designated input channel is a parameter-ganging channel or a non-parameter-ganging channel.

If the designated input channel is a parameter-ganging channel (YES determination at step S26), the CPU 10 of the console 1 proceeds to step S27, where it extracts other parameter-ganging channels with which the parameter control should be ganged, i.e. four other parameter-ganging channels belonging to the same surround channel group as the above-mentioned designated input channel. As noted above, the parameter-ganging channels are the five input channels "L", "R", "C", "Ls" and "Rs" in the surround channel group. The foregoing operations can identify which parameter of which input channels should be changed in value in response to the current change instruction.

At next step S28, the CPU 10 of the console 1 collectively changes, in accordance with content of the human operator's change instruction, values of the designated parameter currently set in the four input channels extracted at step S27 and in the designated input channel. Such "collectively changing" corresponds to the "ganging". Namely, in accordance with the content of the human operator's change instruction, the CPU 10 of the console 1 overwrites values of the parameter currently set in the five input channels of the surround channel group and stored in the current memory provided in the flash memory 11 or RAM 12, and it sends the resultant new value of the designated parameter to the DSP 3. The DSP 3 receives the new value of the designated parameter and changes or sets the values of the parameter currently set in the five input channels to the received new value.

Changing the value of the designated parameter in each of the input channels may be effected in either one of two ways depending on the type of the designated parameter, namely, one in which the value of the designated parameter is changed with an absolute value instructed by the human operator, or one in which the value of the designated parameter is changed with values relative to the value instructed by the human operator. Thus, at step S28, the CPU 10 of the console 1 determines whether the designated parameter is of the type that is to be changed in value with an absolute value or of the type that is to be changed in value with relative values. If the designated parameter is of the type that is to be changed in value with an absolute value, the CPU 10 changes the values of the designated parameter, currently set in all of the input channels of the surround channel group, with such an absolute value corresponding to the human operator's change instruction. If, on the other hand, the designated parameter is of the type that is to be changed in value with relative values, the CPU 10 changes the values of the designated parameter, currently set in all of the input channels of the surround channel group, with such relative values corresponding to the human operator's change instruction.

"changing the values of the designated parameter . . . with an absolute value corresponding to the human operator's instruction" is equivalent to setting the value, instructed by the human operator, as a new value of the designated parameter in each of the input channels of the surround channel group. Namely, if a value "a" of the designated parameter is set by the human operator's change instruction, then the value "a" is set as a new value of the designated parameter in each of the input channels of the surround channel group. Of the ganged type parameters, examples of the parameter whose value is changed with an absolute value are the above-mentioned equalizer (EQ), compressor, sound volume level and channel-ON/OFF parameters.

On the other hand, "changing the values of the designated parameter . . . with relative values corresponding to the human operator's instruction" is equivalent to changing relatively the values of the input channels of the surround channel group in accordance with the value instructed by the human operator. Namely, if a value "a" of the designated parameter is set by the human operator's change instruction, then control is performed such that the value of a given one of the ganged type parameters is increased by a value "b", another one of the ganged type parameters is decreased by a value "c", and so on.

Of the ganged type parameters, examples of the parameter whose value is changed with relative values is the balance parameter of the balance setting section 42. As noted above, whereas the instant embodiment assumes a construction in which no balance setting section 42 is inserted in the case where the "surround channel" type has been set for the input channel in question, such a balance setting section 42 may be inserted as necessary. Once the value of the balance parameter is changed in accordance with a human operator's instruction in the case where the balance setting section 42 is inserted, sound volume level balance among the individual input channels "L" "R", "C", "Ls" and "Rs" is adjusted in accordance with the changed value of the balance parameter, so that a surround pan position (i.e., surround sound image localization) can be adjusted. Namely, the balance parameter is a parameter that is controlled in a ganged manner in a plurality of input channels and that is changed in value with relative values corresponding to a human operator's instruction.

If the designated parameter to be changed in value this time is of the "non-ganged type" (NO determination at step S24), or if the designated input channel is a non-parameter-ganging channel (NO determination at step S26), the CPU 10 of the console 1 branches to step S29, where it changes the value of the designated parameter only in the designated input channel in accordance with the content of the human operator's change instruction; "changing the value of the designated parameter only in the designated input channel" corresponds to the "non-ganging". Namely, the value of the designated parameter stored in the current memory provided in the flash memory 11 or RAM 12 of the console 1 is updated only in the designated input channel, and the updated or new value of the designated parameter is sent to the DSP 3. The DSP 3 receives the new value of the designated parameter and changes or sets the value of the designated parameter of only the designated input channel to the received new value. As noted above, examples of the ganged type parameter are the amplifier gain (and other parameter pertaining to the head amplifier), attenuator, delay, phase switching, etc, and an example of the non-parameter-ganging input channel is an input channel for which "LFE" is set as the input source type.

If the designated input channel does not belong to a surround channel group (NO determination at step S22), and if the channel type set for the designated input channel is "normal channel", then the CPU 10 of the console 1 controls only the designated parameter in the designated input channel. In this manner, the stored content of the current memory is overwritten, and only the value of the designated parameter in the designated input channel is changed or set to the new value (step S30). If the channel type set for the designated input channel is "stereo channel", and if the designated parameter is of the "ganged type", then the CPU 10 of the console 1 controls, in a ganged manner, the designated parameter of the designated input channel and the designated parameter of the other input channel belonging to the same stereo channel group as the designated input channel. Further, if the designated parameter is of the "non-ganged type", then the CPU 10 of the console 1 controls only the value of the designated parameter in the designated input channel. Thus, the stored content of the current memory is overwritten, and the value of the designated parameter in the DSP 3 is set to the new value (operation of step S30).

No description will be given about behavior of the instant embodiment when the human operator has entered a change instruction for changing a value of a parameter of an input channel in an input channel block for which the "normal block" or "stereo block" type is set.

With the process of FIG. 11, the human operator is allowed to adjust a desired parameter of six input channels, to which are allocated audio signals from six 5.1-channel surround input sources, while maintaining a mutual relationship among the input sources and without paying excessive attention to the mutual relationship among the input sources.

As set forth above, the embodiment of the mixing system has the first primary feature in that, in response to the human operator only setting a block type for a plurality of the input channels handling surround signals of a predetermined plurality of channels (e.g., 5.1-channel surround signals comprising six-channel audio signals), it can set the plurality of the input channels as a surround channel group and connect the input channels, belonging to the surround channel group, to the buses that belong to a surround bus group. Thus, the instant embodiment can make a setting for outputting (e.g., surround-reproducing) audio signals of a plurality of channels, which are to be handled together as a set (e.g., 5.1-channel surround signals), as audio signals having a predetermined mutual relationship, in response to extremely simple operation of block type setting.

The embodiment of the mixing system has the second primary feature in that, in response to the human operator setting any one of the channel types, i.e. "parameter-ganging channel" (one of "L", "R", "C", "Ls" and "Rs") and "non-parameter-ganging channel" ("LFE") for each of the input channels belonging to a surround channel group, it can automatically determine whether or not a given parameter should be controlled in a ganged manner within the surround channel group. When adjusting a parameter in the input channels handling audio signals of a plurality of the input channels (e.g., 5.1-channel surround signals), the human operator can perform the parameter adjustment while maintaining a mutual relationship among surround signals of a plurality of channels (e.g., 5.1-channel surround signals comprising six-channel audio signals) and without paying excessive attention to the mutual relationship among respective input sources.

Namely, the above-described embodiment of the mixing system can achieve the superior advantageous benefit that it allows a plurality of input sources to be handled together as a set with an increased ease.

Whereas the embodiment of the mixing system of the invention has been described above in relation to the construction where channel types (or block type) are set per input channel block (i.e., channel types are set collectively for a plurality of the input channels), the structural arrangement for setting channel types for the input channels in the instant embodiment is not limited to the above-described. For example, the user may set a channel type separately for each of the input channels. In such a case, when "stereo channel" or "surround channel" is to be set as the channel type, the user (or human operator) may select in advance two input channels to be combined into a stereo channel group or select six input channels to be combined into a surround channel group, and then set "stereo channel" or "surround channel" collectively for the selected input channel group. In this case, types of input sources may be automatically set, for example, in accordance with the order in which the user selected the input channels or the order of the respective channel numbers. Alternatively, such types of input sources may of course be set directly by the user.

Further, whereas the embodiment of the mixing system of the invention has been described above in relation to the case where 5.1-channel surround signals are used as surround signals, it may be applied to any other type of surround signals, such as 6.1-channel or 7.1-channel surround signals. Where the embodiment of the mixing system of the invention is applied to another type of surround signals than 5.1-channel surround signals, it is only necessary that the embodiment be arranged to deal with such other type of surround signals by changing the number of input channels constituting a surround channel group and the number of buses constituting a surround bus group.

Furthermore, whereas the embodiment of the mixing system of the invention has been described above in relation to the structural arrangement where lines interconnecting desired input channels and various buses are used, separately from the send-level parameter and channel-ON/OFF parameter, as a structural arrangement for interconnecting the desired input channels and the buses (i.e., arrangement for setting a "connection"/"non-connection"), such a structural arrangement may be made using the send-level parameter or the channel-ON/OFF parameter. Namely, when the "connection" is to be set, the current value of the send-level is maintained, or the channel-ON/OFF parameter is set to "ON". When the "non-connection" is to be set, the current value of the send-level from the input channel to the bus is overwritten to $-\infty$ dB, or the channel-ON/OFF parameter is set to "OFF" (and also the send-level is fixed at "$-\infty$ dB" so that the user can not adjust the send-level). The foregoing is a modification of the structural arrangement for setting a connection between one of the input channels and the various buses.

Second Embodiment

The following describe a mixing system that is constructed as a second embodiment of the audio mixer of the present invention, which is characterized in that a display design of a "selected channel display region" (i.e., configuration of GUI elements in the selected channel display region) displayed on the liquid crystal display (display section) 15 is changed in accordance with a channel type set for an input channel.

—Selected Channel Section—

Figure 12:
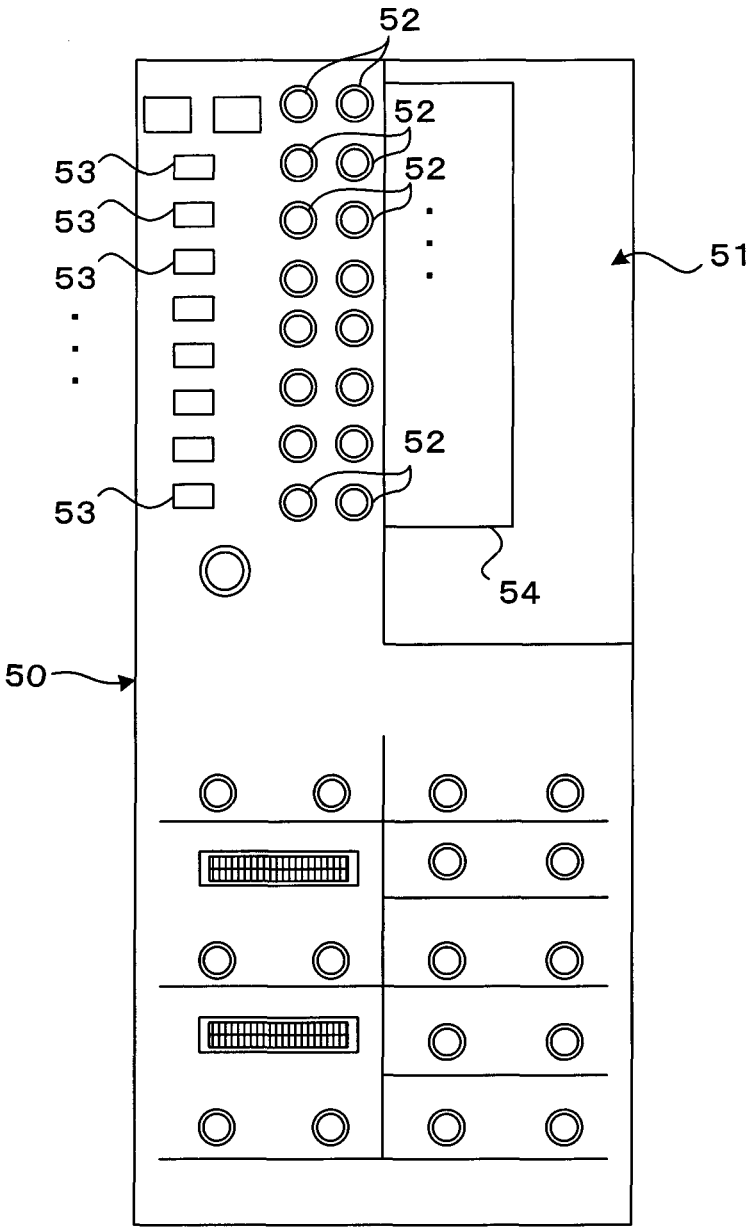
FIG. 12 is a diagram explanatory of a second embodiment of the present invention, which particularly shows a "selected channel section" provided on an operation panel of a console.

FIG. 12 shows a "selected channel section" provided on the operation panel of the console 1. The selected channel section includes a physical operating member region 50 where a plurality of physical operating members are provided, and the selected channel display region 51 provided in a portion of the liquid crystal display (display section) 15. The liquid crystal display 15 is a touch-sensitive panel type display, on which the human operator can enter various instructions using various GUI elements (images of operating members, etc.) displayed on the screen.

The "selected channel section", which is provided as part of the operation panel, is a region for, for a channel selected by the human operator (i.e., selected channel), adjusting in detail various parameters by use of any of the physical operating members provided in the physical operating member region 50 and various GUI elements displayed in the display region 51. Note that a function of calling out one of a plurality of channels to a "selected channel section" has heretofore been known in the field of digital audio mixers. Whereas the following describe an example where an input channel is called out to the "selected channel section", the channel to be called out to the "selected channel section" is not limited to an input channel.

—Physical Operating Member Region—

In the physical operating member region 50, a plurality of knob-type physical operating members 52 are provided for adjusting a parameter (basically a send-level parameter) of an audio signal to be sent from one input channel selected by the user (selected channel) to a bus included in a bus group selected via any one of a plurality of bus group selection switches 53. In the illustrated example of FIG. 12, sixteen knob-type physical operating members 52 are arranged in two vertical rows and eight horizontal rows.

The plurality of bus group selection switches 53 are provided for changing a bus group to be allocated to the plurality of knob-type physical operating members 52 and later-described send-level display region 54. To each of the bus group selection switches 53 is allocated a bus group comprising a set of sixteen buses. Selectable here are eight bus groups each comprising a set of sixteen buses (i.e., bus Nos. 1-16, 17-32, 33-48, 49-64, . . . ). The bus group selection switches 53 are each in the form of a push button, and only one of the eight bus group selection switches 53 is turned on at a time.

To each of the knob-type physical operating members 52 is allocated a different one of the buses included in a sixteen-bus group currently selected through operation of any one of the bus group selection switches 53. Then, a parameter for adjusting a sound characteristic of an audio signal to be sent from one input channel, currently selected in the selected channel section, to the allocated bus is allocated as a parameter to be controlled via the knob-type physical operating member 52. As will be later described, parameter types to be allocated to the individual knob-type physical operating members 52 are determined in accordance with a display design (i.e., a combination of a currently selected channel type and currently selected bus type) of the send-level display region.

—Send-Level Display Region—

In the selected channel display region 51 are displayed parameter images (GUI elements) for adjusting in detail various parameters for the user-selected channel. The selected channel display region 51 includes the send-level display region 54 as shown in FIGS. 13A-13D. The send-level display region 54 is provided for displaying a list of parameter images that are indicative of parameters of an audio signal to be sent from one input channel, currently selected in the selected channel section, to the individual buses included in the bus group currently selected via any one of the bus group selection switches 53. As will be later described in detail, the display design of the send-level display region 54 (i.e., parameter images and parameter types displayed in the send-level display region 54) is changed in accordance with a combination of a channel type (any one of normal channel, stereo channel and surround channel types) of the channel selected in the selected channel section and bus types (normal bus, stereo bus and surround bus) set for the individual buses included in the currently selected bus group.

—Fundamental Type—

Figures 13A, 13B, 13C, 13D:
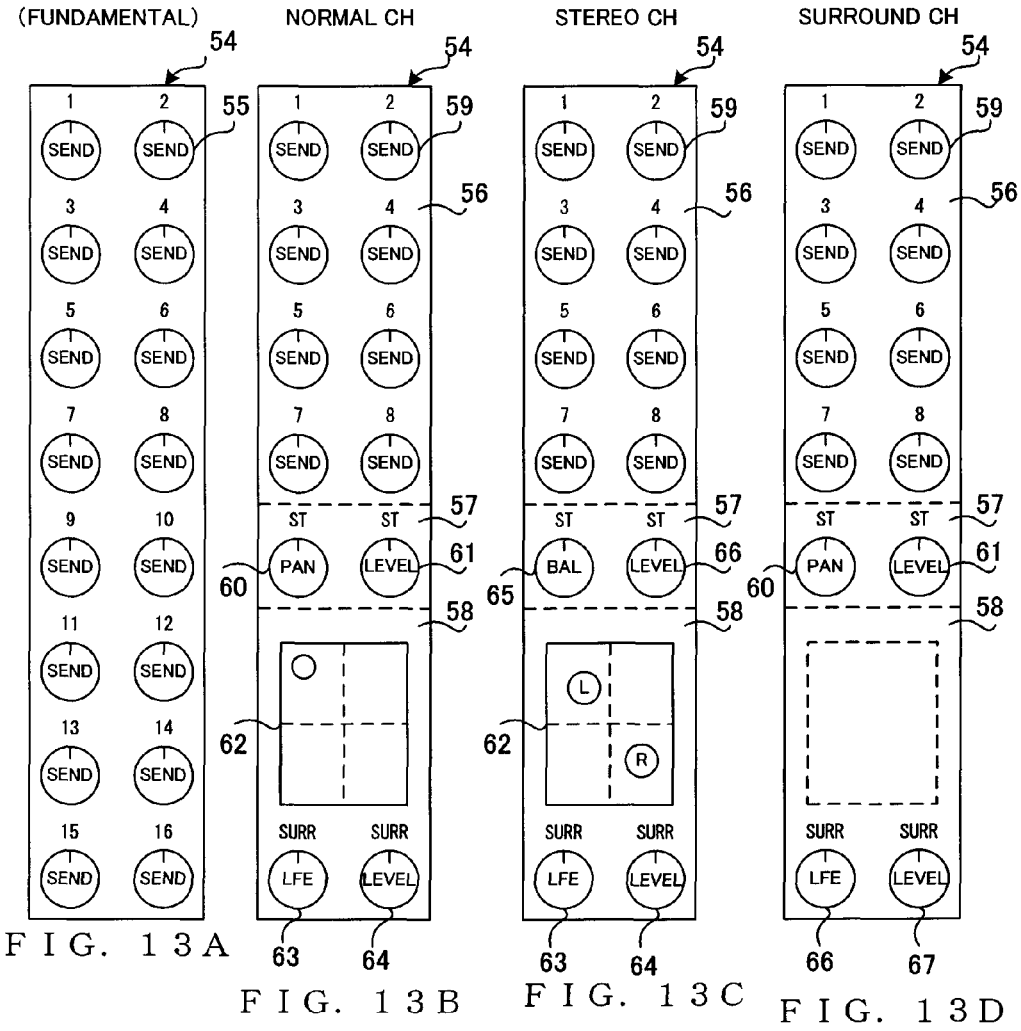

FIG. 13A shows the send-level display region 54 of a "fundamental type", where "normal channel" is set as the channel type for the selected input channel and "normal bus" is set as the bus type for all of the buses of the selected bus group.

Figure 14:
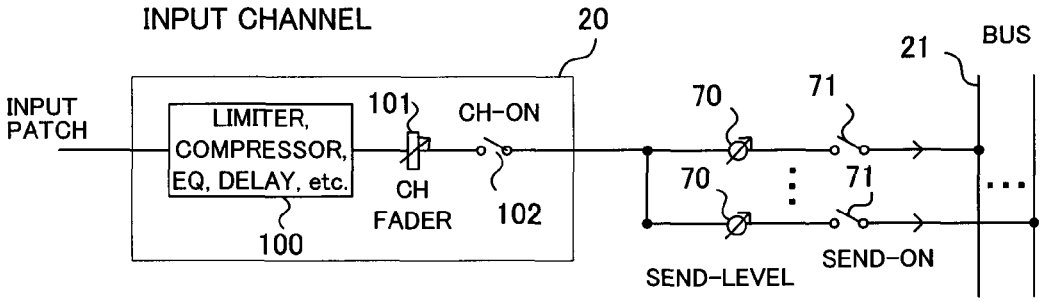
FIG. 14 is a block diagram explanatory of a connection style between an input channel and buses in the fundamental type display design.

FIG. 14 is a block diagram explanatory of a connection style between the input channel and the buses and types of parameters inserted between the input channel and the buses in the "fundamental type" send-level display region 54. In the case of the "fundamental type", the one input channel (normal channel) 21 is connected in parallel to individual ones of the buses (normal buses) 22. Between the input channel and each of the buses 22 are provided the send-level parameter 70 for adjusting a send-level from the input channel to the bus 22, and the send-ON/OFF parameter 71 for setting ON or OFF of signal send from the input channel to the bus 22. An initial value of the send-level parameter 70 is set at $-\infty$ dB (i.e., condition for completely turning down an input sound volume). Further, the send-ON/OFF parameter 71 is initially set at a value indicative of "ON". Namely, the connection between the input channel and each of the buses is initially set at a value indicative of "non-connection" because of the initial value of the send-level parameter 70.

In the "fundamental type" send-level display region 54, as shown in FIG. 13A, knob-type virtual operating member images (send-level operating member images) 55, each indicative of the send-level parameter 70, are displayed as parameter images. Namely, in the "fundamental type" send-level display region 54 are displayed a total of sixteen send-level operating member images 55 which correspond, in a one-to-one relationship, to the buses included in the bus group (i.e., group of sixteen buses) currently selected via any one of the bus group selection switches 53.

The human operator can use any one of the send-level operating member images 55 to adjust a setting value of the parameter (send-level) allocated to that send-level operating member image 55. Such setting value adjustment of the parameter using any one of the send-level operating member images 55 may be performed in any desired one of the conventionally-known ways (operation schemes), such as one in which the human operator points to any one of the send-level operating member images 55 on the touch-sensitive panel type display to virtually operate the image 55, one in which the human operator points to any one of the send-level operating member images 55 and then change the value of the parameter, allocated to that send-level operating member image 55, using some physical operating member, such as a ten-key pad or knob-type physical operating member, or the like. Further, the send-level operating member images 55 may be displayed in different display styles such that current setting values of the parameter allocated to the images 55 are identifiable from the display style; for example, the send-level operating member images 55 may be set at rotational positions corresponding to the respective setting values of the parameter, or the respective setting values of the parameter may be displayed in numerical values near the operating member images 55. Note that all of the knob-type physical operating members described hereinbelow are operable to adjust setting values of the parameter allocated to the images and also arranged to allow the setting values to be identified by their display styles.

Further, the human operator can use any one of the bus group selection switches 53 of FIG. 12 to change a group of the sixteen send-level operating member images 55 (i.e., sixteen buses displayed together in the send-level display region 54) to another group of sixteen send-level operating member images 55. For convenience of description, FIGS. 13A to 13D assume that the buses of bus Nos. 1-16 have been selected as the bus group (sixteen buses) to be displayed together in the send-level display region 54, and the bus numbers allocated to the individual send-level operating member images 55 are indicated in the figures near the corresponding images 55.

Further, in the "fundamental type" send-level display region 54, the sixteen send-level operating member images 55 are arranged in two vertical rows and eight horizontal rows. Such arrangement or layout of the send-level operating member images 55 corresponds to that of the sixteen knob-type physical operating members 52 provided in the physical operating member region 50. To the send-level operating member image 55 and knob-type physical operating member 52 located at corresponding positions is allocated a same parameter (in this case, bus of a same bus number). Thus, the human operator can operate the knob-type physical operating member 52 to change the value of the parameter (i.e., send-level to the bus) allocated to the send-level operating member image 55 corresponding in position to the operated knob-type physical operating member 52. Note that displaying the send-level display region 54 in the aforementioned "fundamental type" display design is a technique that has heretofore been known in the field of digital mixers.

—Change of the Display Design of the Send-Level Display Region—

Figure 15:
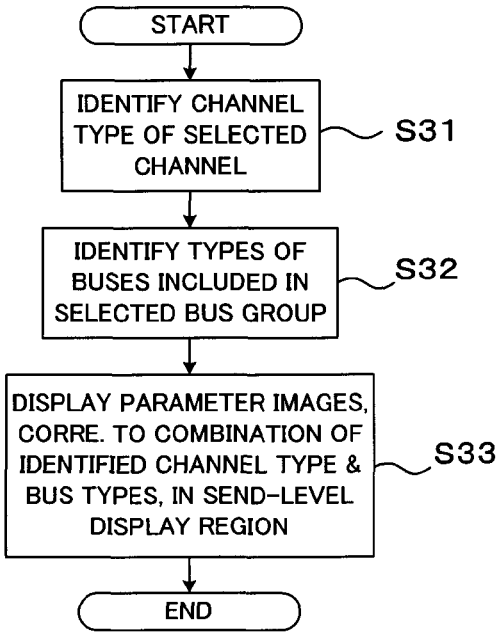
FIG. 15 is a flow chart explanatory of an example operational sequence of a process for changing a display of a send-level display region.

FIG. 15 is a flow chart explanatory of an example operational sequence of a process for changing the display design of the send-level display region. The CPU 10 of the console 1 starts up the process of FIG. 15 upon detection of an instruction for selecting a new input channel as a selected channel to be called out to the selected channel section, or upon detection of a bus group changing instruction (i.e., instruction for selecting a new bus group) given via any one of the bus group selection switches 53.

At step S31, the CPU 10 identifies a channel type set for the input channel to be called out to the "selected channel section", on the basis of the relationship between the input channels and the channel types stored at step S2 above in the flash memory 11 or RAM 12. If an instruction for selecting a new input channel has been detected at start-up of the instant process, the CPU 10 identifies a channel type set for the newly-selected input channel, while, if an instruction for selecting a new bus group has been detected at start-up of the instant process, the CPU 10 identifies a channel type set for a currently-selected input channel.

At next step S32, the CPU 10 identifies bus types set for individual buses included in a bus group to be displayed in the send-level display region. If an instruction for selecting a new input channel has been detected at start-up of the instant process, the CPU 10 identifies bus types set for individual buses included in a currently-selected bus group, while, if an instruction for selecting a new bus group has been detected at start-up of the instant process, the CPU 10 identifies bus types set for individual buses included in a newly-selected bus group.

At following step S33, the CPU 10 changes the display design (configuration of GUI elements (parameter images)) of the send-level display region 54, in accordance with a combination of the channel type and bus types identified at steps S31 and S32 above. More specifically, in accordance with the combination of the channel type and bus types, the CPU 10 determines parameters to be displayed in the send-level display region 54 (i.e., parameters to be allocated to the individual parameter images) and displays parameter images corresponding to the determined parameters. Further, the CPU 10 allocates the parameters, corresponding to the combination of the channel type and bus types identified at steps S31 and S32 (i.e., corresponding to the display design of the send-level display region 54), to individual ones of the sixteen knob-type physical operating members 52 provided in the selected channel section. Further, the CPU 10 stores, into the memory (flash memory 11 or RAM 12), individual parameter images of the send-level display region 54 and parameter type allocated to the individual knob-type physical operating members 52.

With reference to FIGS. 13B-13D, 16, 17 and 18, the following describe the display designs of the send-level display region 54 corresponding to combinations of channel and bus types and parameter types displayed in the send-level display region 54. Let it be assumed here that the bus group of sixteen buses of bus Nos. 1-16 have been selected via one of the bus group selection switches 53, and that the "normal bus" type has been set for the buses of bus Nos. 1-8, the "stereo bus" type has been set for two buses of bus Nos. 9 and 10 forming a stereo bus group and the "surround bus" type has been set for six buses of bus Nos. 10 to 16 forming a surround bus group.

—In the Case of the Normal Channel Type—

Figure 16:
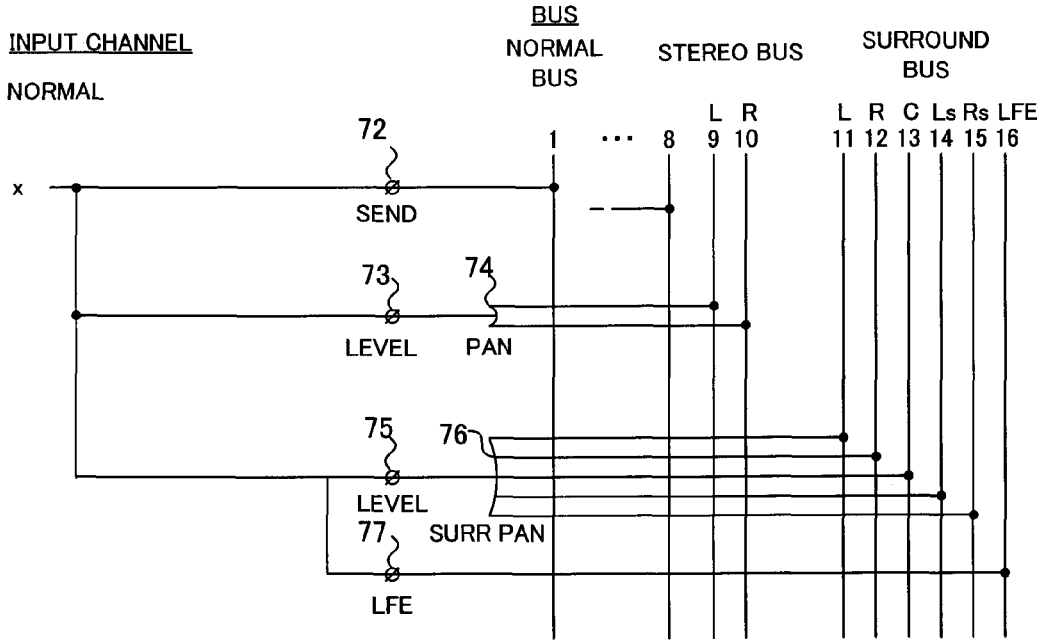
FIG. 16 is a diagram showing a connection style between an input channel and individual buses in a case where the "normal channel" type is set.

In a case where the channel type set for a selected input channel is "normal channel", then the send-level display region 54 is displayed in a display design shown in FIG. 13B. FIG. 16 is a diagram showing a connection style between the input channel "X" for which the "normal channel" type is set and the individual buses, as well as parameters inserted between the input channel "X" and the individual buses (i.e., parameters displayed in the send-level display region 54). Note that the connection style between the input channel "X" and the normal buses, stereo buses and surround buses is similar to that shown and described in FIG. 8.

—Combination of the Normal Channel and the Normal Buses—

As shown in FIG. 16, the input channel "X", for which the "normal channel" type is set, is set to be connected in parallel to individual ones of eight normal buses via send-level parameters 72; namely, one send-level parameter 72 is set for each of the normal buses. The send-level parameter 72 is a parameter for adjusting a send-level from the input channel "X" to the normal bus. Although not particularly shown, a per-bus send-ON/OFF parameter may be provided at a stage following the send-level parameter 72 in a similar manner to FIG. 14.

In a normal bus region 56 shown in FIG. 13B are displayed eight knob-type virtual operating member images (i.e., send-level operating images) 59 indicative of the send-level parameters 72 of FIG. 16. The human operator can use any one of the eight send-level operating images 59 to adjust the send-level from the currently-selected input channel to the bus corresponding to the one send-level operating image 59 among the eight normal buses (bus Nos. 1-8) included in the currently-selected bus group. The bus numbers of the normal buses corresponding to the send-level operating images 59 are indicated near the respective images 59.

—Combination of the Normal Channel and the Stereo Buses—

As shown in FIG. 16, the input channel "X" is set to be connected to a pair of the stereo buses "L" and "R" via a level parameter 73 and a pan parameter 74; namely, one level parameter 73 and one pan parameter 74 are set for the two buses. Note that, in the illustrated example of FIG. 8, parameters inserted in the lines interconnecting the input channel "X" and the stereo bus group are shown as a single block of "Pan 40". The pan parameter 74 is a parameter for adjusting stereo panning from the input channel "X" to the stereo bus group (two stereo buses "L" and "R"). The level parameter 73 is a parameter provided, at a stage preceding the pan parameter 74, for adjusting a level of an audio signal to be supplied from the input channel "X" to the pan parameter 74, to thereby simultaneously adjust audio signals to be sent to both of the two stereo buses "L" and "R.

In a stereo bus region 57 shown in FIG. 13B are displayed knob-type virtual operating member images (i.e., pan operating images) 60 indicative of the pan parameter 74 to the stereo buses of FIG. 16 and knob-type virtual operating member images (i.e., level operating images) 61 indicative of the level parameter 73 of FIG. 16. The human operator can use any one of the pan operating images 60 to adjust stereo panning from the currently-selected input channel to the stereo bus group (i.e., stereo bus L of bus No. 9 and stereo bus R of bus No. 10) included in the currently-selected bus group. Further, the human operator can use any one of the level operating images 61 to adjust a level of an audio signal to be sent from the currently-selected input channel to the stereo bus group included in the currently-selected bus group. Near the pan operating images 60 and level operating images 61 is displayed a letter string "ST" indicating that the parameters allocated to these images pertain to the stereo buses.

—Combination of the Normal Channel and the Surround Buses—

As shown in FIG. 16, the input channel "X" is not only set to be connected to the five surround buses "L", "R", "C", "Ls" and "Rs" of the surround bus group via a level parameter 75 and a surround pan parameter 76, but also set to be connected to the remaining one surround bus "LFE" via an LFE level parameter 77. Namely, one level parameter 75 and one surround pan parameter 76 are set for the five surround buses "L", "R", "C", "Ls" and "Rs", and one LFE level parameter 77 is set for the surround bus "LFE". Note that, in illustrated example of FIG. 8, parameters inserted in the lines interconnecting the input channel "X" and the surround bus group are shown as a single block of "Surround Pan 41". The surround pan parameter 76 is a parameter for adjusting surround panning from the input channel "X" to the five surround buses "L", "R", "C", "Ls" and "Rs". The level parameter 75 is a parameter provided, at a stage preceding the surround pan parameter 76, for adjusting a level of an audio signal to be supplied from the input channel "X" to the surround pan parameter 76, to thereby simultaneously adjust audio signals to be sent to the five surround buses "L", "R", "C", "Ls" and "Rs". The LFE level parameter 77 is a parameter for adjusting a level of an audio signal to be supplied from the input channel "X" to the one bus "LFE".

In a surround bus region 58 shown in FIG. 13B are displayed, as parameter images, a sound image localization image 62 indicative of the surround pan parameter 76 of FIG. 16, a knob-type virtual operating member image (i.e., LFE-channel level operating image) 63 indicative of the LFE level parameter 77 of FIG. 16, and a knob-type virtual operating member image (i.e., surround-channel level operating image) 64 indicative of the level parameter 75 of FIG. 16. The sound image localization image 62 indicates, on two-dimensional coordinates, a setting of sound image localization corresponding to a setting value of the surround pan parameter 76 for a currently-selected input channel. The setting value of the surround pan parameter 76 may be adjusted using the sound image localization image 62 (e.g., through operation of designating a sound image localization position on the two-dimensional coordinates). The human operator can use the LFE-level operating image 63 to adjust a sound level of an audio signal to be sent from the currently-selected input channel to the surround bus "LFE" (bus No. 16) included in the currently-selected bus group. The human operator can also use the surround-channel level operating image 64 to adjust a level of an audio signal to be sent from the currently-selected input channel to the surround buses "L", "R", "C", "Ls" and "Rs" (bus Nos. 11-15) included in the currently-selected bus group. Near the LFE-level operating image 63 and surround-channel level operating image 64 is displayed a letter string "SURR" indicating that the parameters allocated to the images 63 and 64 s pertain to the surround buses.

—In the Case of the Stereo Channel—

Figure 17:
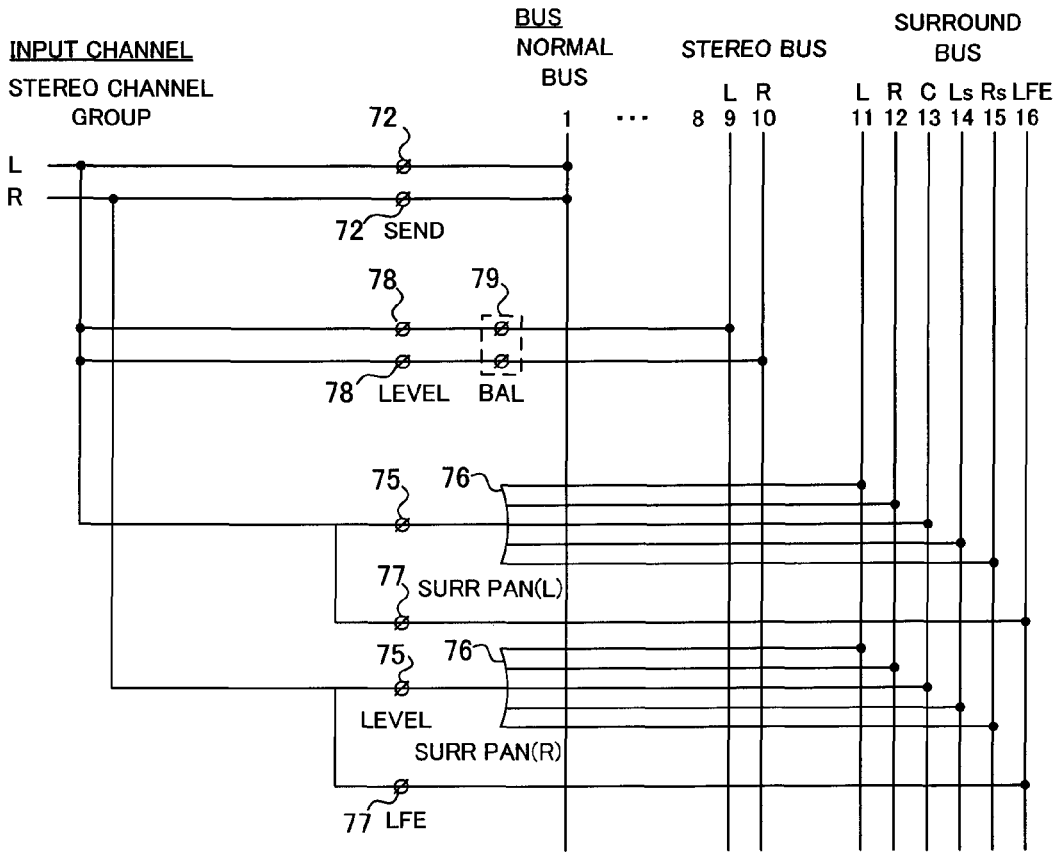
FIG. 17 is a block diagram explanatory of a connection style between input channels belonging to a stereo channel group and various buses in a case where the "stereo channel" type is set.

In a case where the channel type set for a selected input channel is "stereo channel", then the send-level display region 54 is displayed in a display design shown in FIG. 13C. FIG. 17 is a diagram showing a connection style between two input channels ("L" and "R"), for which the "stereo channel" type is set, and individual buses, as well as parameters inserted between the input channels and the individual buses. Note that the connection style between the input channels ("L" and "R") and the normal buses, stereo buses and surround buses is similar to those shown and described in FIG. 9.

—Combination of the Stereo Channels and the Normal Buses—

As shown in FIG. 17, the input channels ("L" and "R") are each set to be connected to individual ones of eight normal buses via send-level parameters 72 as in the combination of the normal channel and the normal buses shown in FIG. 16.

As shown in FIG. 13C, a normal bus region 56 pertaining to the combination between the stereo channels and the normal buses is displayed in a display design similar to that shown in FIG. 13B. Namely, in the normal bus region 56 of FIG. 13C are displayed, as parameter images, eight send-level operating images 59 indicative of the send-level parameters 72 of FIG. 17, in a generally similar manner to FIG. 13B. The human operator can use any one of the eight send-level operating images 59 to adjust the send-level from the currently-selected input channel ("L" or "R") to the bus allocated to the image 59 among the eight normal buses (bus Nos. 1-8) included in the currently-selected bus group.

—Combination of the Stereo Channels and the Stereo Buses—

As shown in FIG. 17, the stereo input channel "L" is set to be connected to the stereo bus "L" via a level parameter 78 and a balance parameter 79, while the stereo input channel "R" is set to be connected to the stereo bus "R" via a level parameter 78 and a balance parameter 79. Note that, in illustrated example of FIG. 9, parameters inserted in the lines interconnecting the input channel "L" and the stereo bus group are shown as a single block of "Balance Setting Section 42".

The balance parameters 79 are parameters for adjusting sound volume level balance of audio signals to be sent from the input channel "L" to the stereo bus "L" and from the input channel "R" to the stereo bus "R" simultaneously or in a ganged fashion in the input channels ("L" and "R"). The balance parameters 79 operate in the same manner as the balance setting section 42. The level parameters 78 are each provided at a stage preceding the balance parameter 79 for adjusting a level of an audio signal from the corresponding input channel ("L" or "R") to the corresponding stereo bus ("L" or "R") (i.e., audio signal to be supplied to the balance parameter 79). Note that the level parameters 78 may be arranged to adjust levels of audio signals from the two input channels "L" and "R", having a stereo relationship therebetween, to the stereo buses "L" and "R" simultaneously or in a ganged fashion in the input channels ("L" and "R").

In a stereo bus region 57 shown in FIG. 13C are displayed, as parameter images, a knob-type virtual operating member image (i.e., balance operating image) 65 indicative of the balance parameter 79 of FIG. 17 and a knob-type virtual operating member image (i.e., level operating image) 66 indicative of the level parameter 78 of FIG. 17. The human operator can use the balance operating image 65 to adjust sound volume level balance between audio signals to be sent from the currently-selected input channel and other input channel, having a stereo relationship with the currently-selected input channel, to the stereo buses (bus Nos. 9 and 10) included in the currently-selected bus group, simultaneously or in a ganged manner in the input channels ("L" and "R"). Further, the human operator can use the level operating image 66 to adjust the level of the audio signal to be sent from the currently-selected input channel to the two stereo buses (bus Nos. 9 and 10) included in the currently-selected bus group. In a case where the level parameter 78 is arranged to operate in a ganged manner in the stereo buses ("L" and "R"), human operator's operation of the level operating image 66 can adjust levels of audio signals to be sent from the currently-selected input channel and other input channel, having a stereo relationship with the currently-selected input channel, to the stereo buses (bus Nos. 9 and 10) included in the currently-selected bus group, simultaneously or in a ganged manner in the input channels ("L" and "R").

—Combination of the Stereo Channels and the Surround Buses—

As shown in FIG. 17, the input channels ("L" and "R") are each set not only to be connected to the five surround buses "L", "R", "C", "Ls" and "Rs" of the surround bus group via a level parameter 75 and a surround pan parameter 76, but also set to be connected to the remaining one surround bus "LFE" via an LFE level parameter 77, as in the combination between the normal channel and the surround buses of FIG. 16. Note that, in illustrated example of FIG. 9, parameters inserted in the lines interconnecting the input channels ("L" and "R") and the surround bus group are shown as a single block of "Surround Pan 41". In the case of the combination of the stereo channels and the surround buses, the parameters 75 and 77 of the two input channels ("L" and "R"), set in a stereo relationship with each other, may be arranged to be adjusted simultaneously or in a ganged relation in the two input channels ("L" and "R").

As shown in FIG. 13C, a surround bus region 58 pertaining to the combination between the stereo channels and the surround buses is displayed in a display design generally similar to that shown in FIG. 13B. Namely, in the surround bus region 58 shown in FIG. 13C are displayed, as parameter images, a sound image localization image 62, a LFE-channel level operating image 63 and a surround-channel level operating image 64. The human operator can use the LFE-level operating image 63 to adjust a sound level of an audio signal to be sent from the currently-selected input channel to the surround bus "LFE" (bus No. 16) included in the currently-selected bus group. The human operator can also use the surround-channel level operating image 64 to adjust a level of an audio signal to be sent from the currently-selected input channel ("L" or "R") to the surround buses "L", "R", "C", "Ls" and "Rs" (bus Nos. 11-15) included in the currently-selected bus group. The sound image localization image 62 indicates, on two-dimensional coordinates, a setting of sound image localization corresponding to a setting value of the surround pan parameter 76, for each of the currently-selected input channel and other input channel having a stereo relationship with the currently-selected input channel (i.e., stereo input channels "L" and "R"). Namely, the surround bus region 58 of FIG. 13C is different from the surround bus region 58 of FIG. 13B in that the sound image localization image 62 of FIG. 13C indicates settings of sound image localization of two stereo input channels.

The combination between the stereo channels and the surround buses may be arranged in such a manner that the human operator can use the LFE-level operating image 63 to adjust levels of audio signals to be sent from the currently-selected input channel and the other input, channel having a stereo relationship with the currently-selected input channel, (i.e., stereo input channels "L" and "R") to the surround bus "LFE" (bus No. 16), simultaneously or in a ganged manner in the input channels "L" and "R". Further, the combination between the stereo channels and the surround buses may be arranged in such a manner that the human operator can also use the level operating image 64 to adjust levels of audio signals to be sent from the currently-selected input channel and the other input, channel having a stereo relationship with the currently-selected input channel, (i.e., stereo input channels "L" and "R") to the five surround buses "L", "R", "C", "Ls" and "Rs" (bus Nos. 11-15) included in the currently-selected bus group, simultaneously or in a ganged manner in the input channels "L" and "R".

—In the Case of the Surround Channel—

Figure 18:
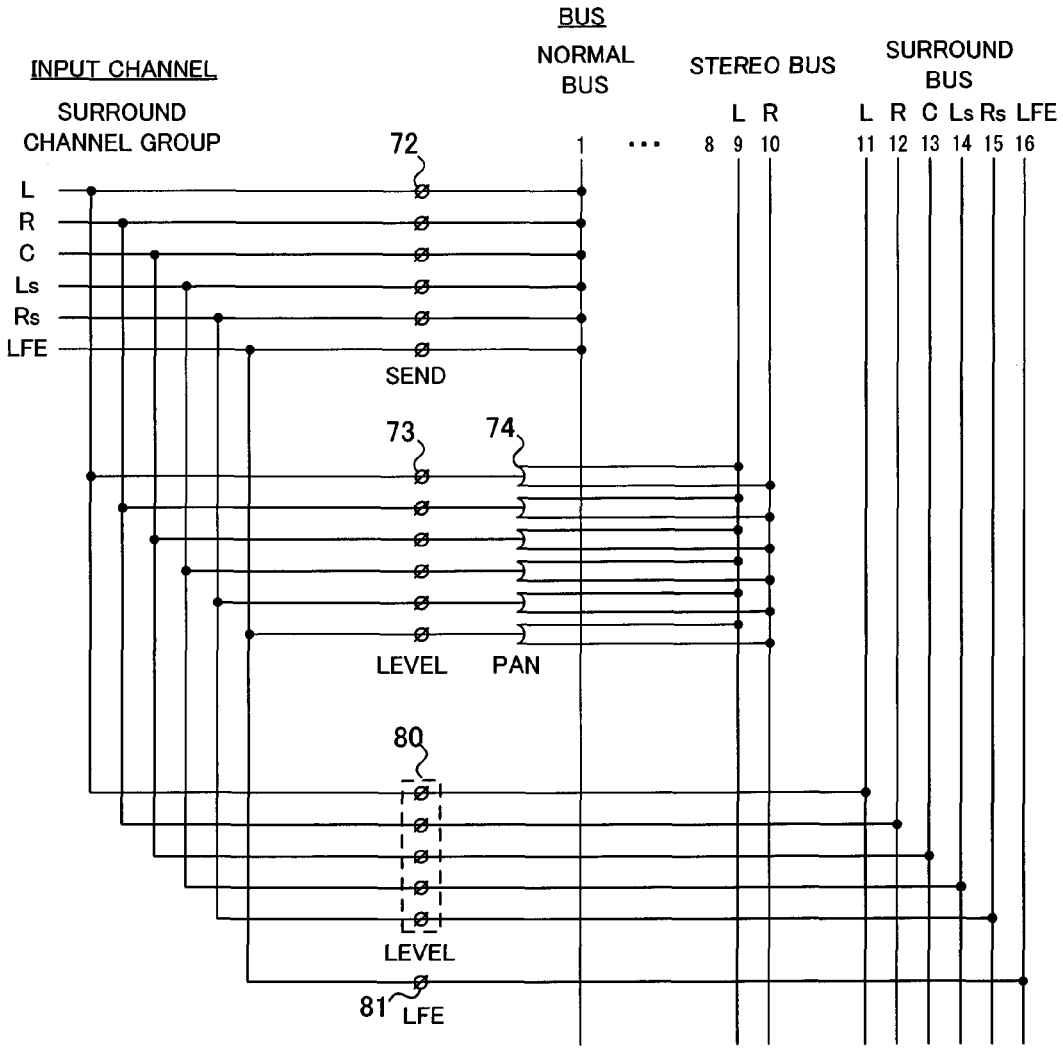
FIG. 18 is a block diagram explanatory of a connection style between input channels belonging to a surround channel group and various buses in a case where the "surround channel" type is set.

In a case where the channel type set for a selected input channel is "surround channel", then the send-level display region 54 is displayed in a display design shown in FIG. 13D. FIG. 18 is a diagram showing a connection style between the six input channels ("L", "R", "C", "Ls", "Rs" and "LFE") of the surround channel type and the individual buses, as well as parameters inserted between the individual input channels and the individual buses (i.e., parameters displayed in the send-level display region 54). Note that the connection style between the input channels and the normal buses, stereo buses and surround buses in FIG. 18 is similar to that shown and described in FIG. 10.

—Combination of the Surround Channels and the Normal Buses—

As shown in FIG. 18, each of the input channels ("L", "R", "C", "Ls", "Rs" and "LFE"), constituting one surround channel group, is set to be connected to individual ones of eight normal buses via send-level parameters 72 in a similar manner to the aforementioned combination between the normal channel and the normal buses of FIG. 16.

As shown in FIG. 13D, a normal bus region 56 pertaining to the combination between the surround channels and the normal buses is displayed in a display design generally similar to that shown in FIG. 13B. Namely, in the normal bus region 56 of FIG. 13D are displayed, as parameter images, eight send-level operating images 59 indicative of the send-level parameters 72 of FIG. 18. The human operator can use any one of the eight send-level operating images 59 to adjust the send-level from the currently-selected input channel (any one of "L", "R", "C", "Ls", "Rs" and "LFE") to the bus allocated to the image 59 among the eight normal buses (bus Nos. 1-8) included in the currently-selected bus group.

—Combination of the Surround Channels and the Stereo Buses—

As shown in FIG. 18, each of the input channels ("L", "R", "C", "Ls", "Rs" and "LFE"), constituting one surround channel group, is set to be connected to individual ones of a pair of stereo buses "L" and "R" via level parameters 73 and pan parameters 74 in a similar manner to the aforementioned combination between the normal channel and the stereo buses of FIG. 16.

As shown in FIG. 13D, a stereo bus region 57 pertaining to the combination between the surround channels and the stereo buses is displayed in a display design generally similar to that of the stereo bus region shown in FIG. 13B. Namely, in the stereo bus region 57 shown in FIG. 13D are displayed a pan operating image 60 indicative of the pan parameter 74 of FIG. 18 and a level operating image 61 indicative of the level parameter 73 of FIG. 18. The human operator can use the pan operating image 60 to adjust stereo panning from the currently-selected input channel (any one of "L", "R", "C", "Ls", "Rs" and "LFE") to the stereo bus group (i.e., stereo bus L of bus No. 9 and stereo bus R of bus No. 10) included in the currently-selected bus group. Further, the human operator can use the level operating image 61 to adjust a level of an audio signal to be sent from the currently-selected input channel (any one of "L", "R", "C", "Ls", "Rs" and "LFE") to the stereo bus group included in the currently-selected bus group.

—Combination of the Surround Channels and the Surround Buses—

As shown in FIG. 18, each of five input channels ("L", "R", "C", "Ls" and "Rs") of six input channels ("L", "R", "C", "Ls", "Rs" and "LFE") constituting a surround channel group is set to be connected to a corresponding one of surround buses ("L", "R", "C", "Ls" and "Rs") via a level parameter 80. One of the six input channels ("LFE") constituting the surround channel group is set to be connected to one of the buses ("LFE") of the surround channel group via an LFE level parameter 81. The level parameters 80 provided for individual ones of the five input channels are parameters for adjusting, simultaneously (or in a ganged manner in the input channels), levels of audio signals to be sent from the input channel "L" to the surround bus "L", from the input channel "R" to the surround bus "R", from the input channel "C" to the surround bus "C", from the input channel "Ls" to the surround bus "Ls" and from the input channel "Rs" to the surround bus "Rs". Thus, the level parameters 80 provided for the five input channels are each set at a same value, in order to maintain a surround pan (sound image localization) setting set in advance for the five input channels ("L", "R", "C", "Ls" and "Rs"). The LFE level parameter 81 is a parameter for adjusting a level of an audio signal to be sent from the input channel "LFE" to the surround bus "LFE".

In a surround bus region 58 shown in FIG. 13D are displayed, as parameter images, a knob-type virtual operating member image (LFE level operating image) 66 indicative of the LFE level parameter 81 of FIG. 18 and a knob-type virtual operating member image (level operating image) 67 indicative of the level parameter 80 of FIG. 18. In the case of the surround channel group, a mutual relationship (i.e., surround pan (sound image localization) setting) is preset among the six input channels, and thus, no surround pan parameter is inserted at a stage preceding the surround buses, as seen in FIG. 18. Thus, no sound image localization is displayed in the surround bus region 58.

Further, in FIG. 13D, the LFE level operating image 66 always displays a level of an audio signal to be sent from the LFE input channel to the surround bus "LFE" (bus No. 16) included in the currently-selected bus group, regardless of which of the input channels of the surround channel group the currently-selected input channel is. The human operator can use the LFE-level operating image 66 to adjust a sound level of an audio signal to be sent from the LFE input channel of the surround channel group, to which the currently-selected input channel belongs, to the surround bus "LFE" (bus No. 16) included in the currently-selected bus group. Further, irrespective of which of the input channels of the surround channel group the currently-selected input channel is, the level operating image 67 displays levels of audio signals from the five input channels ("L", "R", "C", "Ls" and "Rs") of the surround channel group, to which the currently-selected input channel belongs, to the five surround buses ("L", "R", "C", "Ls" and "Rs"). Thus, irrespective of which of the input channels of the surround channel group the currently-selected input channel is, the level operating image 67 displays a same value as the level parameter. The human operator can use the level operating image 67 to adjust, simultaneously (or in a ganged manner in the input channels), levels of audio signals from the five input channels ("L", "R", "C", "Ls" and "Rs") of the surround channel group, to which the currently-selected input channel belongs, to the five surround buses ("L", "R", "C", "Ls" and "Rs"). Namely, in the case of the combination of the surround channels and the surround buses, the parameters allocated to the LFE-level operating image 66 and level operating image 67 do not necessarily pertain to the channel currently selected in the selected channel section.

—Parameter Allocation to the Physical Operating Members—

Parameters to be allocated to the sixteen knob-type physical operating members 52 provided in the selected channel section are determined by the CPU 10 through the operation of step S33 of FIG. 15 in accordance with the combination between the channel and bus types identified at steps S31 and S32 above, i.e. in accordance with the display design of the send-level display region 54. As noted above, the layout of the sixteen virtual operating member images 55 displayed in the "fundamental type" display design shown in FIG. 13A corresponds to the layout of the sixteen knob-shaped physical operating members 52 provided in the physical operating member region 50, and a same parameter (i.e., bus of a same bus No.) is allocated to the virtual operating member image 55 and knob-shaped physical operating member 52 located at corresponding positions. In the display design shown in FIG. 13B, 13C or 13D as well, a same parameter (i.e., bus of a same bus No.) is allocated to the virtual operating member image 55 and knob-shaped physical operating member 52 located at corresponding positions.

In the case where the send-level display region 54 is displayed in the display design shown in FIG. 13B, 13C or 13D, objects to be controlled by the knob-shaped physical operating members 52 of bus Nos. 1-8 are send-level parameters allocated to the send-level operating images 59 of bus Nos. 1-8 displayed in the normal bus region 56. For example, a send-level parameter allocated to the send-level operating image 59 of bus No. 1 is allocated as an object to be controlled by the physical operating member 52 of bus No. 1.

Further, in the case where the send-level display region 54 is displayed in the display design shown in FIG. 13B, 13C or 13D, parameters allocated to the parameter images displayed in the stereo bus region 57 are allocated as objects to be controlled by the knob-shaped physical operating members 52 of bus Nos. 9 and 10. Furthermore, in the case where the send-level display region 54 is displayed in the "normal channel" display design shown in FIG. 13B or in the "surround channel" display design shown in FIG. 13D, an object to be controlled by the knob-shaped physical operating member 52 of bus No. 9 is a pan parameter allocated to the pan operating image 60, and an object to be controlled by the knob-shaped physical operating member 52 of bus No. 10 is a level parameter allocated to the level operating image 61. Further, in the case where the send-level display region 54 is displayed in the "stereo channel" display design shown in FIG. 13C, an object to be controlled by the knob-shaped physical operating member 52 of bus No. 9 is a balance parameter allocated to the balance operating image 65, and an object to be controlled by the knob-shaped physical operating member 52 of bus No. 10 is a level parameter allocated to the level operating image 61.

Furthermore, in the case where the send-level display region 54 is displayed in the display design shown in FIG. 13B, 13C or 13D, parameters allocated to the parameter images displayed in the surround bus region 58 are allocated as objects to be controlled by the knob-shaped physical operating members 52 of bus Nos. 11-16. As shown in FIG. 13B, 13C or 13D, the sound image localization image 62 is displayed in a position corresponding to the four physical operating members 52 of bus Nos. 11, 12, 13 and 14 of FIG. 13A, or nothing is displayed in that position. Surround pan (sound image localization) allocated to the sound image localization image 62 cannot be operated by any knob-type operating member. Thus, no parameter to be controlled is allocated to the four physical operating members 52 of bus Nos. 11, 12, 13 and 14. An object to be controlled by the physical operating member of bus No. 15 is an LFE level parameter allocated to the LFE level operating image 63 or 66, and an object to be controlled by the physical operating member of bus No. 16 is a level parameter allocated to the level operating image 64 or 67.

—Parameter Adjustment Responsive to Operation of a Physical Operating Member—

Figure 19:
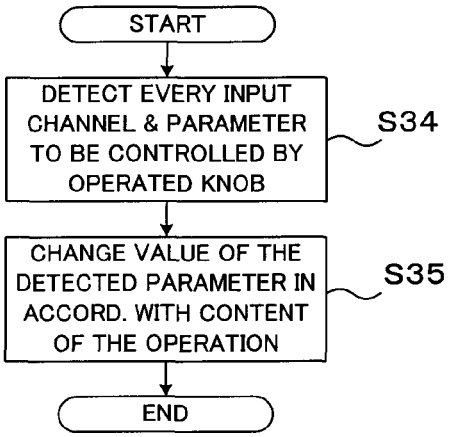
FIG. 19 is a flow chart explanatory of an example operational sequence of a process for adjusting a parameter using any one of knob-type physical operating members in the selected channel section.

FIG. 19 is a flow chart explanatory of an example operational sequence of a process for adjusting a parameter in response to operation of any one of the physical operating members 52. The CPU 10 of the console 1 starts up the process of FIG. 19 upon detection of operation of any one of the sixteen physical operating members 52 provided in the selected channel section.

Namely, upon detection of operation of any one of the physical operating members 52, the CPU 10 goes to step S34 to detect every input channel and parameter to be controlled by the operated physical operating member 52. As set forth above, the parameter to be controlled by the operated physical operating member 52 is determined in accordance with a combination of channel and bus types of one input channel currently selected in the selected channel section ("selected channel").

The input channel detected at step S34 as an object to be controlled by the operated physical operating member 52 is essentially the one input channel currently selected in the selected channel section ("selected channel"). If the currently selected input channel belongs to a surround channel group, then, as an exception, another input channel than the selected channel is detected as an object to be controlled, or a plurality of input channels in the surround channel group to which the selected channel belongs are detected as an object to be controlled. Namely, if the knob-shaped physical operating member 52 having the LFE level parameter allocated thereto (i.e., in the example of FIG. 13D, the physical operating member 52 corresponding to bus No. 15) has been operated, the CPU 10 always detects the input channel "LFE" as an object to be controlled, irrespective of which of the input channels of the surround channel group the selected channel is. If the knob-shaped physical operating member 52 having the level parameter allocated thereto (i.e., in the example of FIG. 13D, the physical operating member 52 corresponding to bus No. 16) has been operated, the CPU 10 always detects the five input channels ("L", "R", "C", "Ls" and "Rs") of the surround channel group, irrespective of which of the input channels of the surround channel group the selected channel is.

At step S35, the CPU 10 changes a setting value of the detected parameter of all of the detected input channels in accordance with content of the operation (operated amount, operated direction, etc.) of the detected knob-shaped physical operating member 52. Then, the stored content of the current memory provided in the flash memory 11 is updated on the basis of the changed parameter setting.

—Modification Pertaining to the Combination Between the Stereo Channels and the Stereo Buses—

Figure 20A:
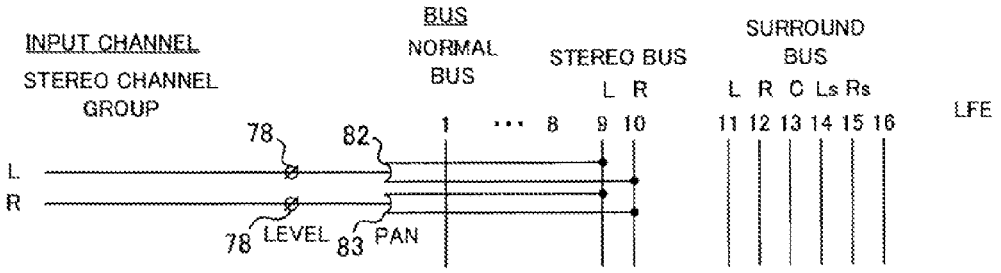
FIGS. 20A and 20B are diagrams explanatory of a modification of the connection style between the stereo input channels and the stereo buses shown in FIG. 17.
Figure 20B:
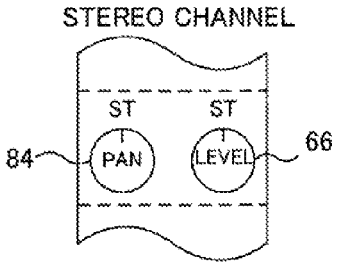

FIGS. 20A and 20B are diagrams explanatory of a modification of the connection style between the stereo channels and the stereo buses shown in FIG. 17. Whereas the input channels "L" and "R" belonging to a stereo channel group are connected to the stereo buses "L" and "R", respectively, in the connection style of FIG. 17, the input channels "L" and "R" belonging to a stereo channel group are each connected to the stereo buses "L" and "R" in the modified connection style of FIG. 20A. In the modified connection style of FIG. 20A, pan parameters 82 and 83 replace the balance parameter 79 of FIG. 17. Namely, in modified connection style of FIG. 20A, an audio signal of the input channel "L" of the stereo channel group is divided, via the level parameter 78 and pan parameter 82, into two audio signals that are supplied to the stereo buses "L" and "R". Similarly, an audio signal of the input channel "R" of the stereo channel group is divided, via the level parameter 78 and pan parameter 83, into two audio signals that are supplied to the stereo buses "L" and "R". The pan parameters 82 and 83 each adjust stereo panning from the corresponding input channel "L" or "R" to the stereo buses "L" and "R".

FIG. 20B shows a display design of the stereo bus region 57 for stereo input channels displayed in the case where the connection style of FIG. 20A is employed. As shown in the figure, a pan operating member image 84 replaces the balance operating image 65 of FIG. 13C. The pan operating member image 84 displays panning from the currently-selected input channel ("L" or "R") to the stereo buses "L" and "R".

—Modification Pertaining to the Combination Between the Surround Channels and the Stereo Buses—

Figure 21A:
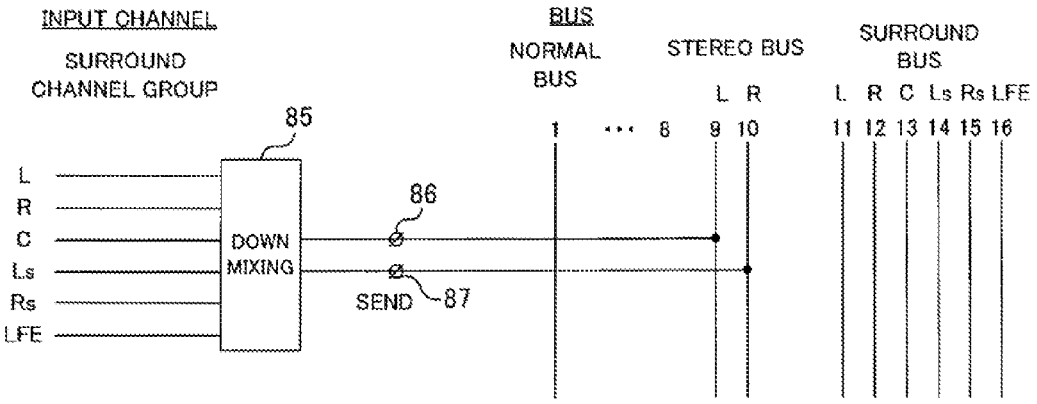
FIGS. 21A and 21B are diagrams explanatory of a modification of the connection style between the surround input channels and the stereo buses shown in FIG. 18.
Figure 21B:
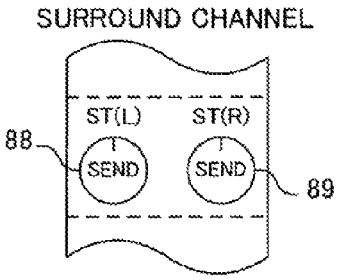

FIGS. 21A and 21B are diagrams explanatory of a modification of the connection style between the surround channels and the stereo buses shown in FIG. 18. Whereas the six input channels ("L", "R", "C", "Ls", "Rs" and "LFE") constituting a surround channel group are each connected to the stereo buses ("L" and "R") in the connection style of FIG. 18, audio signals of the six input channels ("L", "R", "C", "Ls", "Rs" and "LFE") constituting a surround channel group are mixed via a down-mixing section 85 into two-channel stereo signals. Of the two-channel stereo signals thus mixed down, the signal of the L channel is supplied to the stereo bus "L" while the signal of the R channel is supplied to the stereo bus "R". A L-channel send-level parameter 86 is inserted between the down-mixing section 85 and the stereo bus "L", and a R-channel send-level parameter 87 is inserted between the down-mixing section 85 and the stereo bus "R".

FIG. 21B shows a display design of the stereo bus region 57 for surround input channels displayed in the case where the connection style of FIG. 21A is employed. As shown in the figure, a L-channel send-level operating member image 88 and R-channel send-level operating member image 89 replace the LFE-channel level operating image 66 and surround-channel level operating image 67, respectively, of FIG. 13D. The L-channel send-level operating member image 88 always displays a L-channel send-level setting for adjusting a send-level with which the L-channel signal of the mixed-down two-channel stereo signals is sent to the stereo bus "L", irrespective of which of the input channels of the surround channel group the selected channel is. Similarly, the R-channel send-level operating member image 89 always displays a R-channel send-level setting for adjusting a send-level with which the R-channel signal of the mixed-down two-channel stereo signals is sent to the stereo bus "R", irrespective of which of the input channels of the surround channel group the selected channel is.

The display schemes (i.e., display designs shown in FIGS. 13B, 13C and 13D) of the send-level display region, employed in the above-described second embodiment, can efficiently display the parameters inserted in paths lying from the input channel, selected in the selected channel section, to various buses in an appropriate style, easy for the human operator to follow, in accordance with a combination of a channel type of an input channel and a bus type. Further, in the display designs shown in FIGS. 13B, 13C and 13D, the displayed position of the stereo bus region 57 corresponds to the physical operating members of bus Nos. 9 and 10, and the displayed position of the surround bus region 58 corresponds to the physical operating members of bus Nos. 11-16. Thus, the second embodiment can achieve the advantageous benefit that the human operator is allowed to readily recognize or follow visually to which bus (i.e., to which bus number) a parameter currently displayed in the send-level display region pertains and to which of the physical operating members 52 the currently-displayed parameter corresponds.

It should be appreciated that, whereas the embodiments of the present invention have been described above as applied to the mixing system comprising the console 1, I/O device 2 and engine 3, the present invention can be constructed and implemented as a digital audio mixer having the functions of the console 1, I/O device 2 and engine 3 incorporated in a single casing. Further, the behavior and construction of the digital audio mixer, to which the basic principles of the present invention are applied, may be constructed and implemented by a software program executed by a CPU.

The mixing system of the present invention may be embodied as audio mixing systems (acoustic systems) for use in various scenes, such as PA (Public Address) systems in concert venues, large-scale events, etc., local-area broadcasting systems in facilities like department stores and schools, and recording systems in music recording studios.

This application is based on, and claims priorities to, JP PA 2009-077307 filed on 26 Mar. 2009 and JP PA 2009-267864 filed on 25 Nov. 2009. The disclosure of the priority applications, in its entirety, including the drawings, claims, and the specification thereof, is incorporated herein by reference.

What is claimed is:

1. An audio mixer comprising:

a plurality of input channels to which one or more audio signals supplied from input sources are inputted, each of said input channels inputting thereto any one of the audio signals;

a surround bus group constituted by a given number of buses corresponding to a necessary number of channels for achieving a predetermined surround effect;

a channel grouping section which, in response to a user's operation, groups, as a surround channel group, a given number of input channels, included among said plurality of input channels, corresponding in number to the given number of buses constituting the surround bus group, and which sets, as a non-parameter-ganging channel, at least one of the input channels belonging to the surround channel group;

a connection section which connects each of the input channels, belonging to the surround channel group, to a corresponding one of the buses belonging to the surround channel group;

an instruction reception section which receives a change instruction for changing a value of a parameter for one of the input channels belonging to the surround channel group;

a determination section which determines whether or not the input channel, for which the change instruction has been received, is the non-parameter-ganging channel; and a parameter control section which, when said determination section has determined that said input channel, for which the change instruction has been received, is not a non-parameter-ganging channel, controls, on the basis of the change instruction, values of the parameter in all input channels of the surround channel group that are not non-parameter-ganging channels, and which, when said determination section has determined that said input channel, for which the change instruction has been received, is a non-parameter-ganging channel, controls, on the basis of the change instruction, a value of the parameter only in said input channel for which the change instruction has been received.

2. The audio mixer as claimed in claim 1, wherein said plurality of input channels are divided into a plurality of input channel blocks, each of the input channel blocks comprising a specific number of input channels that is equal to or greater than the given number of input channels constituting the surround channel group, wherein said channel grouping section further includes:

a channel block designation section which designates any one of the input channel blocks; and a block type designation section which designates, for the input channel block designated by said channel block designation section, a block type for defining a group configuration of the input channels belonging to the designated input channel block, and wherein, of the input channels belonging to the designated input channel block, the given number of input channels, corresponding in number to the given number of buses constituting the surround bus group, is grouped as a surround channel group on the basis of the designated input channel block, and at least one of the input channels belonging to the surround channel group is set as a non-parameter-ganging channel.

3. The audio mixer as claimed in claim 1, which includes a plurality of the surround bus groups.

4. The audio mixer as claimed in claim 1, wherein the predetermined surround effect is a 5.1-channel surround effect.

5. The audio mixer as claimed in claim 1, wherein the predetermined surround effect is a 7.1-channel surround effect.

6. The audio mixer as claimed in claim 1, wherein said channel grouping section sets, as the non-parameter-ganging channel, a low frequency effect channel in the predetermined surround effect.

7. The audio mixer as claimed in claim 1, which further comprises a plurality of mixing buses each capable of mixing audio signals of one or more desired input channels of said plurality of input channels.

8. The audio mixer as claimed in claim 1, wherein said instruction reception section receives the change instruction given by a human operator.

* * * * *